US008412070B2

(12) United States Patent
Kikuchi et al.

(10) Patent No.: US 8,412,070 B2
(45) Date of Patent: Apr. 2, 2013

(54) ELECTROPHOTOGRAPHIC IMAGE FORMING APPARATUS INCLUDING A CARTRIDGE MOUNTING FEATURE

(75) Inventors: Ken Kikuchi, Mishima (JP); Tsutomu Nishiuwatoko, Numazu (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 320 days.

(21) Appl. No.: 12/728,649

(22) Filed: Mar. 22, 2010

(65) Prior Publication Data

US 2010/0239312 A1 Sep. 23, 2010

(30) Foreign Application Priority Data

Mar. 23, 2009 (JP) ..... 2009-069962

(51) Int. Cl.
*G03G 21/16* (2006.01)

(52) U.S. Cl. ..... 399/111; 399/110; 399/112; 399/113; 399/119

(58) Field of Classification Search ..... 399/110–113, 399/119
See application file for complete search history.

(56) References Cited

U.S. PATENT DOCUMENTS 6,041,203 A * 3/2000 Suzuki et al. ..... 399/111
6,141,513 A 10/2000 Nishiuwatoko et al.
6,336,012 B1 1/2002 Noda et al.
6,366,746 B1 4/2002 Sasago et al.
6,385,413 B2 5/2002 Sasaki et al.
6,606,469 B2 8/2003 Kikuchi et al.
6,647,227 B2 * 11/2003 Yokoi et al. ..... 399/111
6,968,138 B2 11/2005 Akutsu
2003/0053819 A1 3/2003 Nomura et al.
2007/0147890 A1 6/2007 Hayakawa
2007/0160380 A1 7/2007 Imaizumi et al.
2007/0160386 A1 7/2007 Kawamura
2008/0019732 A1 * 1/2008 Sato et al. ..... 399/112
2008/0181658 A1 7/2008 Okabe

FOREIGN PATENT DOCUMENTS

JP 2006-184901 A 7/2006

* cited by examiner

*Primary Examiner* — Ryan Walsh
(74) *Attorney, Agent, or Firm* — Fitzpatrick, Cella, Harper & Scinto

(57) ABSTRACT

An electrophotographic image forming apparatus for forming an image on a recording material, includes an electrophotographic photosensitive drum; a cartridge including a developing roller for developing an electrostatic latent image formed on the electrophotographic photosensitive drum, the cartridge containing a developer for effecting development and including a force receiving portion, wherein the cartridge is mounted to a main assembly of the electrophotographic image forming apparatus; and an urging member for urging the cartridge; wherein by mounting the cartridge, the force receiving portion receives a force from the urging member to urge the developing roller to the electrophotographic photosensitive drum.

5 Claims, 23 Drawing Sheets

ELECTROPHOTOGRAPHIC IMAGE FORMING APPARATUS INCLUDING A CARTRIDGE MOUNTING FEATURE

FIELD OF THE INVENTION AND RELATED ART

The present invention relates to an electrophotographic image forming apparatus for forming an image on a recording material, wherein cartridge is dismountably mounted to a main assembly of the apparatus.

Here, the electrophotographic image forming apparatus forms an image on the recording material using an electrophotographic image forming process. The examples of the electrophotographic image forming apparatus include an electrophotographic copying machine, an electrophotographic printer (a laser beam printer, an LED printer, for example), a facsimile device, and a word processor. The image is formed by the electrophotographic image forming apparatus on a recording material, and the recording material is paper, an OHP sheet, for example.

The cartridge is a process cartridge, a developing cartridge or the like and contributes to an image forming process for forming the image on the recording material in the state that it is mounted to the main assembly of the electrophotographic image forming apparatus. Here, the process cartridge contains at least one of the charging means, developing means, cleaning means as process means, and the electrophotographic photosensitive drum as a unit integrally, and it is dismountably mountable to the main assembly. The process cartridge may contain the developing means as the process means and the electrophotographic photosensitive drum as a unit, and it is dismountably mounted to the main assembly of the electrophotographic image forming apparatus. The process cartridge may contain the charging means, the developing means, or the cleaning means as the process means and the electrophotographic photosensitive drum as a unit, and it is dismountably mounted to the main assembly. The process cartridge which is provided integrally with the electrophotographic photosensitive drum and the developing means is called an integral-type process cartridge. The process cartridge which is provided integrally with the electrophotographic photosensitive drum and the process means other than the developing means is called a discrete type process cartridge. In this case, the developing means is provided in a developing unit unintegral with the process cartridge, and the discrete type process cartridge forms the image using the combination with such a developing unit. The mounting and demounting of the process cartridge can be carried out relative to the main assembly by a user. For this reason, the maintenance of the apparatus is easy. The act of the process means is carried out on the electrophotographic photosensitive drum.

The developing cartridge is provided with a developing roller, contains a developer (toner) for developing an electrostatic latent image formed on the electrophotographic photosensitive drum, and is dismountably mounted to the main assembly. In the case of the developing cartridge, the electrophotographic photosensitive drum is mounted to a main assembly or a cartridge supporting member. Or, the electrophotographic photosensitive drum is provided in a so-called discrete type process cartridge In this case, the process cartridge is not provided with the developing means. The developing cartridge can be mounted and demounted relative to the main assembly by the user. For this reason, the maintenance of the apparatus is easy.

Therefore, the cartridge in this invention includes the process cartridges of a so-called the integral type or a so-called discrete type. The cartridge includes a combination of the so-called process cartridge of the discrete type and the developing cartridge. In another example of the cartridge, the electrophotographic photosensitive drum is mounted fixedly to the main assembly or the cartridge supporting member, and the detachably mountable developing cartridge acts on the electrophotographic photosensitive drum.

As has been described hereinbefore, the electrophotographic image forming apparatus for forming the image on the recording material using the electrophotographic image forming process is known. In this electrophotographic image forming apparatus, the process cartridge type described above is known. In addition, the developing cartridge type which comprises only the developing unit unintegral with the photosensitive drum is known. In the present invention, the process cartridge type and the developing cartridge type are usable. The process cartridge and the developing cartridge are provided with a developer accommodating portion which contains the developer (toner) for developing the electrostatic latent image.

In a color image forming apparatus, the developing cartridge which is provided with the developing roller is mounted to the main assembly which is provided with a plurality of photosensitive member units. The structure is known in which an urging member in interrelation with a door acts on the developing cartridge by shutting the door of the main assembly, to press the developing roller to the photosensitive drum with the predetermined urging force (US2007-147890). In the color image forming apparatus, a plurality of photosensitive members are mounted in a case. The structure is known in which the user mounts a developing device in the case, thereafter the lever is moved to fix the developing device to the frame (US2003-053819).

SUMMARY OF THE INVENTION

With the former structure, a mechanism for operating the door and the urging member interrelatedly are required. With the latter structure the user needs to operate a lever.

It is an object of the present invention to provide a an electrophotographic image forming apparatus, wherein a developing roller provided in the cartridge is positioned relative to an electrophotographic photosensitive drum provided in the main assembly, with the simple structure. It is a further object of the present invention to provide an electrophotographic image forming apparatus by mounting the cartridge to the main assembly, the developing roller can be urged to the electrophotographic photosensitive drum.

According to an aspect of the present invention, there is provided an electrophotographic image forming apparatus for forming an image on a recording material, comprising an electrophotographic photosensitive drum; a cartridge including a developing roller for developing an electrostatic latent image formed on said electrophotographic photosensitive drum, said cartridge containing a developer for effecting development and including a force receiving portion, wherein said cartridge is mounted to a main assembly of said electrophotographic image forming apparatus; and an urging member for urging said cartridge, wherein by mounting said cartridge, said force receiving portion receives a force from said urging member to urge said developing roller to said electrophotographic photosensitive drum.

According to an aspect of the present invention, the developing roller provided in the cartridge is positioned relative to the electrophotographic photosensitive drum provided in the main assembly, with the simple structure. Kaigyo According to another aspect of the present invention, by mounting the cartridge to the main assembly, the developing roller can be urged to the electrophotographic photosensitive drum.

These and other objects, features, and advantages of the present invention will become more apparent upon consideration of the following description of the preferred embodiments of the present invention, taken in conjunction with the accompanying drawings.

Figure 3:
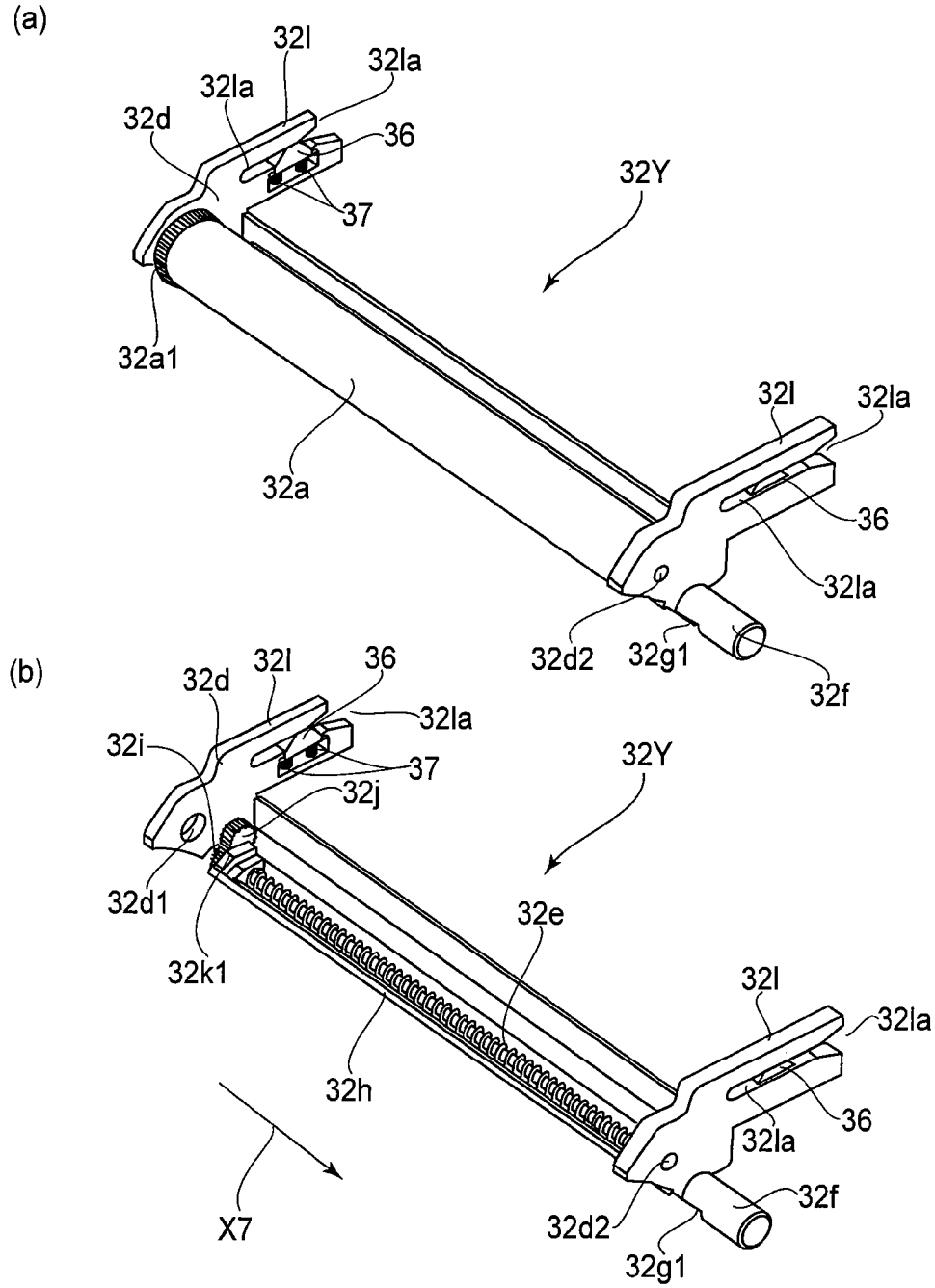

Part (*a*) of FIG. 3 is a left-hand side perspective view of one photosensitive member unit, and (*b*) is a perspective view of the photosensitive member unit (photosensitive member case) from which a drum, a charging roller, and a cleaning blade are dismounted.

Figure 4:
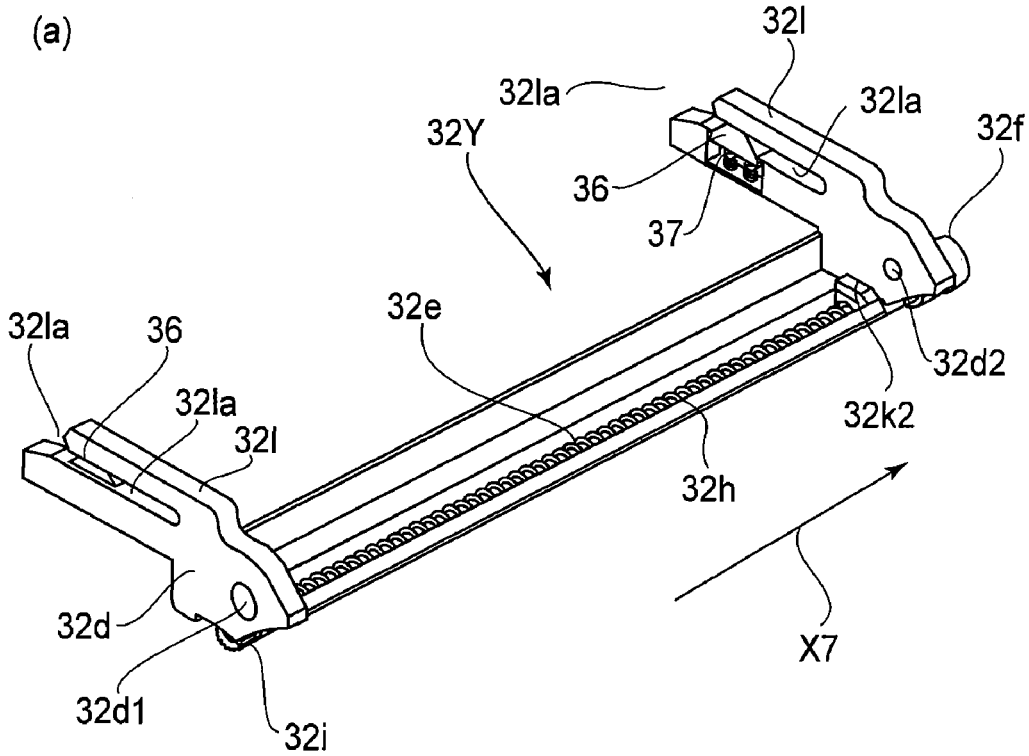
Figure 4:
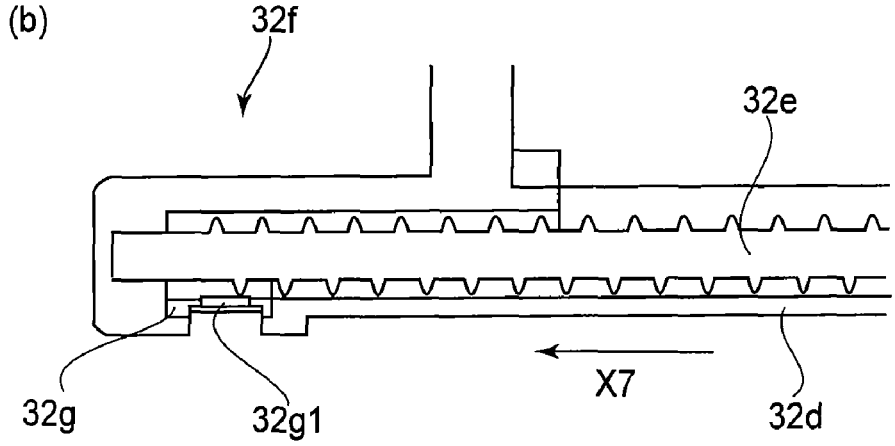

Part (*a*) of FIG. 4 is a right-hand side perspective view of the photosensitive member case of (*b*) of FIG. 3, and (*b*) is an enlarged vertical longitudinal sectional view of a removed developer discharging portion of the photosensitive member case.

Figure 5:
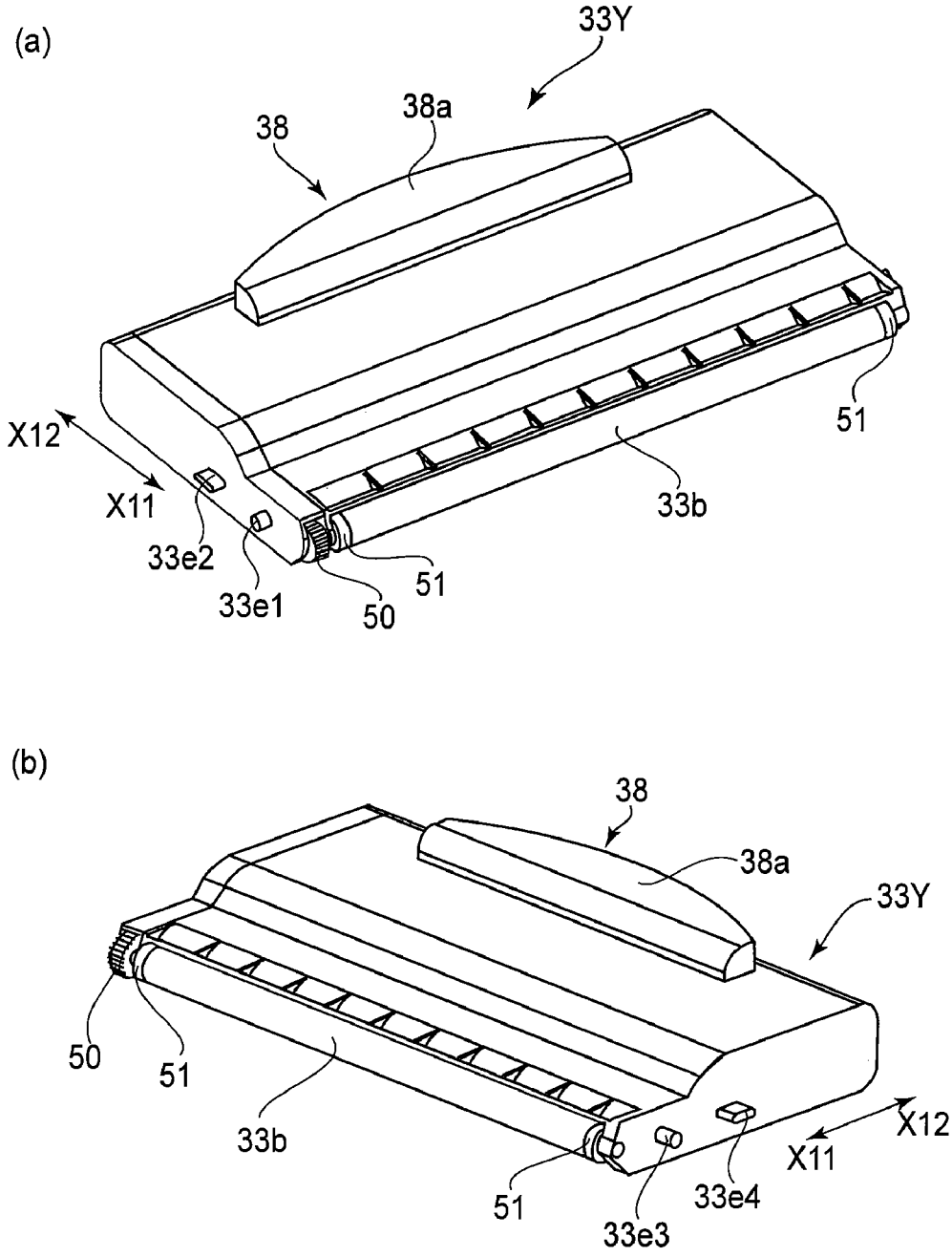

Part (*a*) of FIG. 5 is a right-hand side perspective view of a cartridge, and (*b*) is a left-hand side perspective view thereof.

Figure 6A:
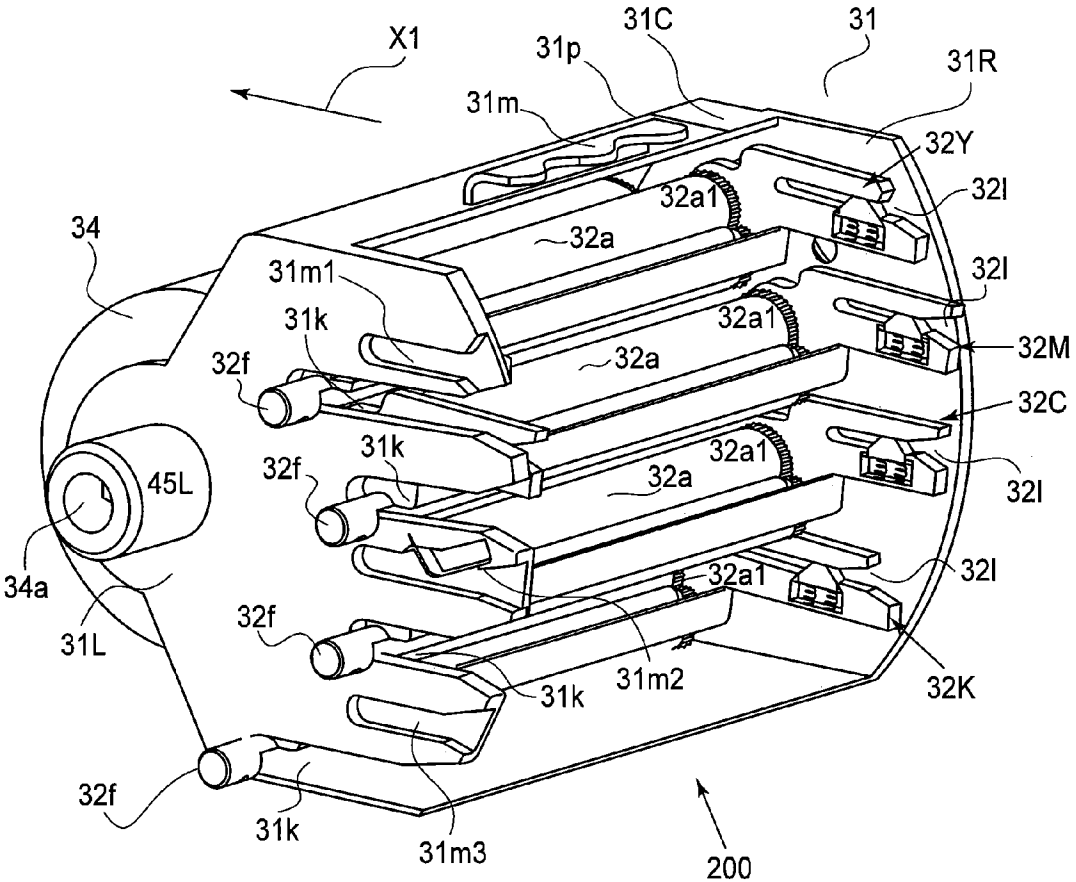
Figure 6B:
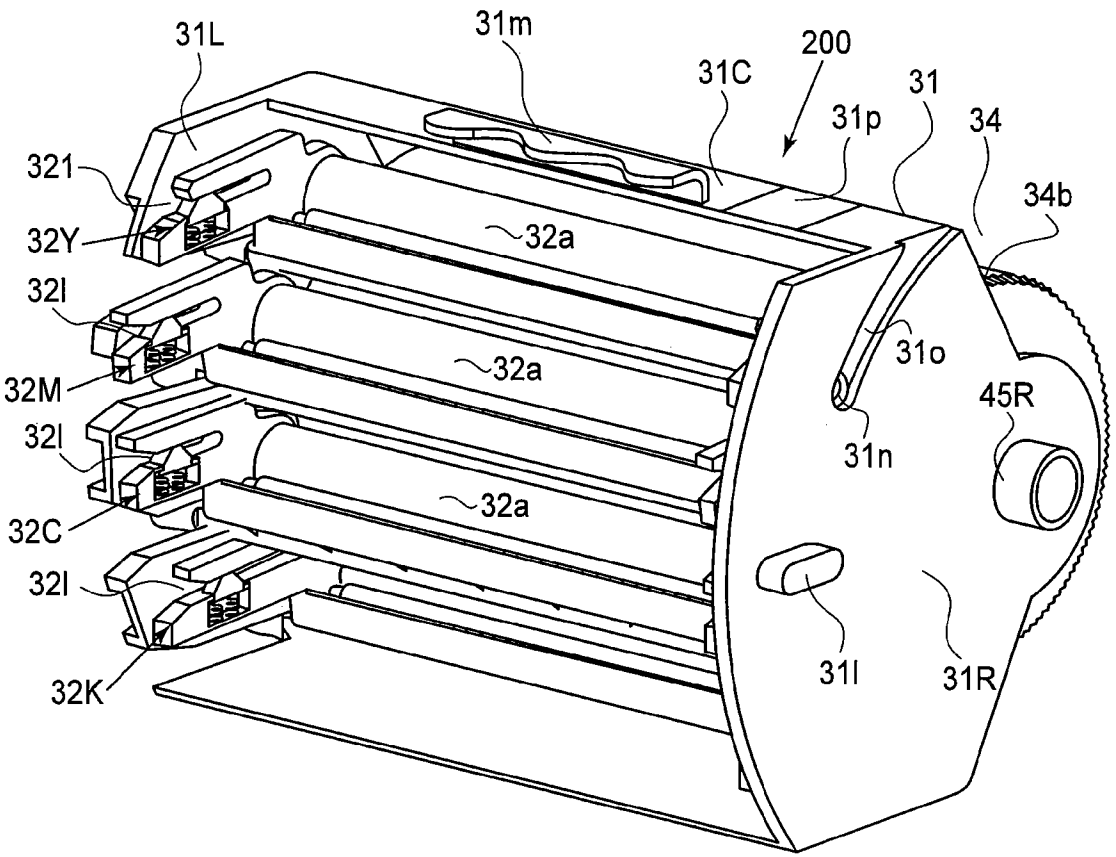

FIG. 6A is a left-hand side perspective view of an image forming unit, and, and FIG. 6B is a right-hand side perspective view thereof.

Figure 7:
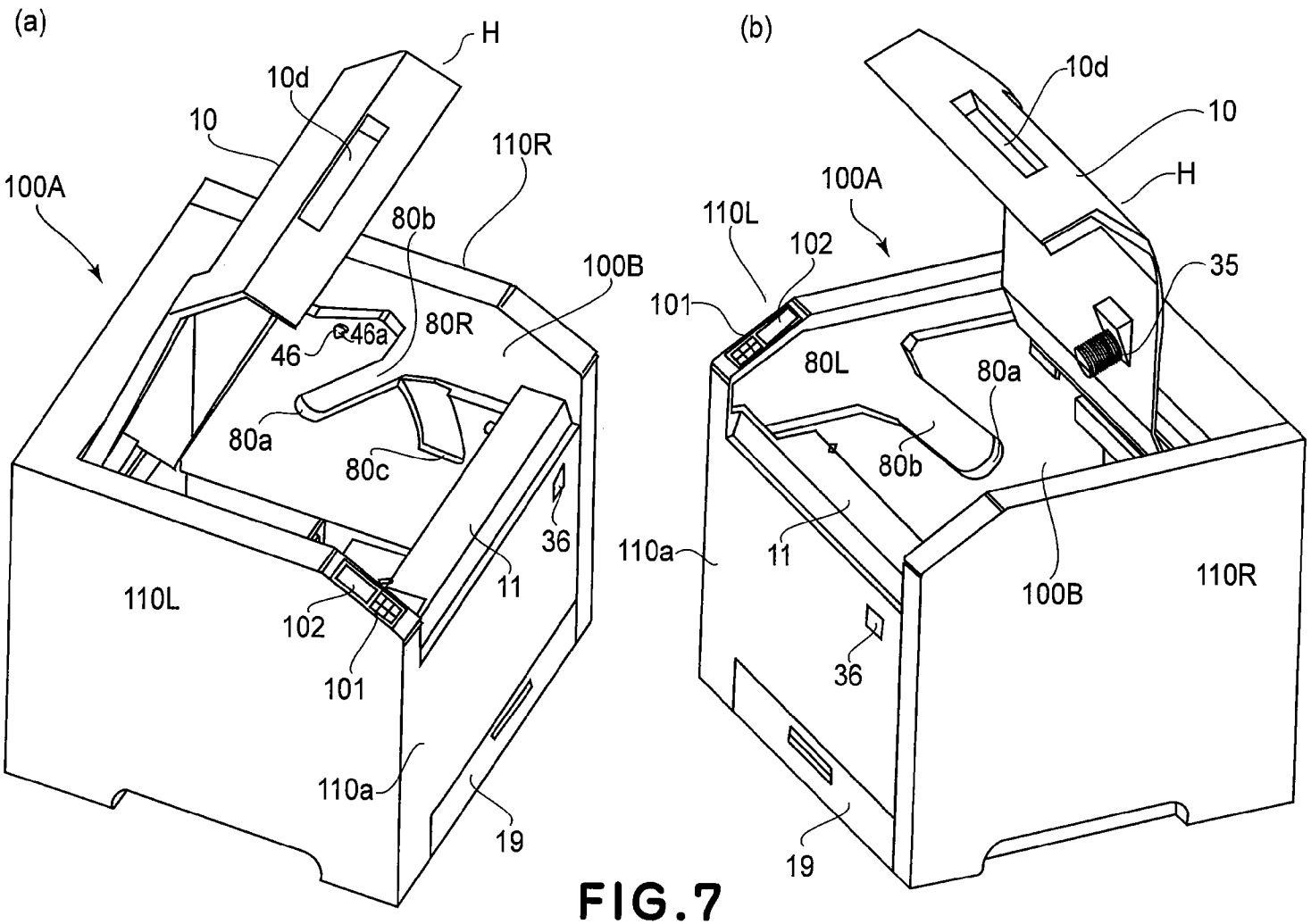

Part (*a*) of FIG. 7 is a left-hand side perspective view of a main assembly in the state that a maintenance cover is open, and (*b*) is a right-hand side perspective view thereof.

Figure 8:
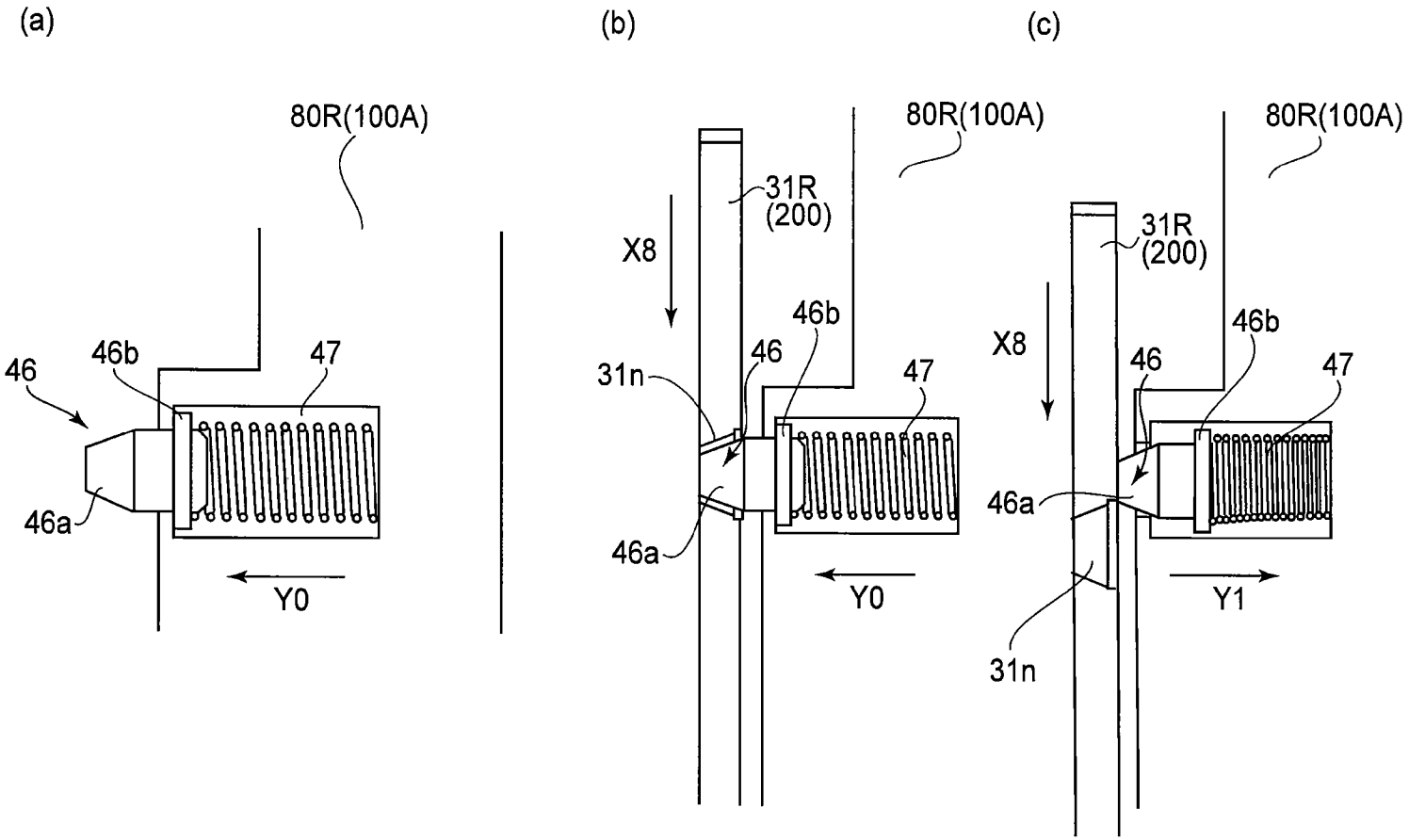

FIG. 8 is an illustration of a regulating portion of the main assembly and the portion-to-be-regulated of the image forming unit.

Figure 9:
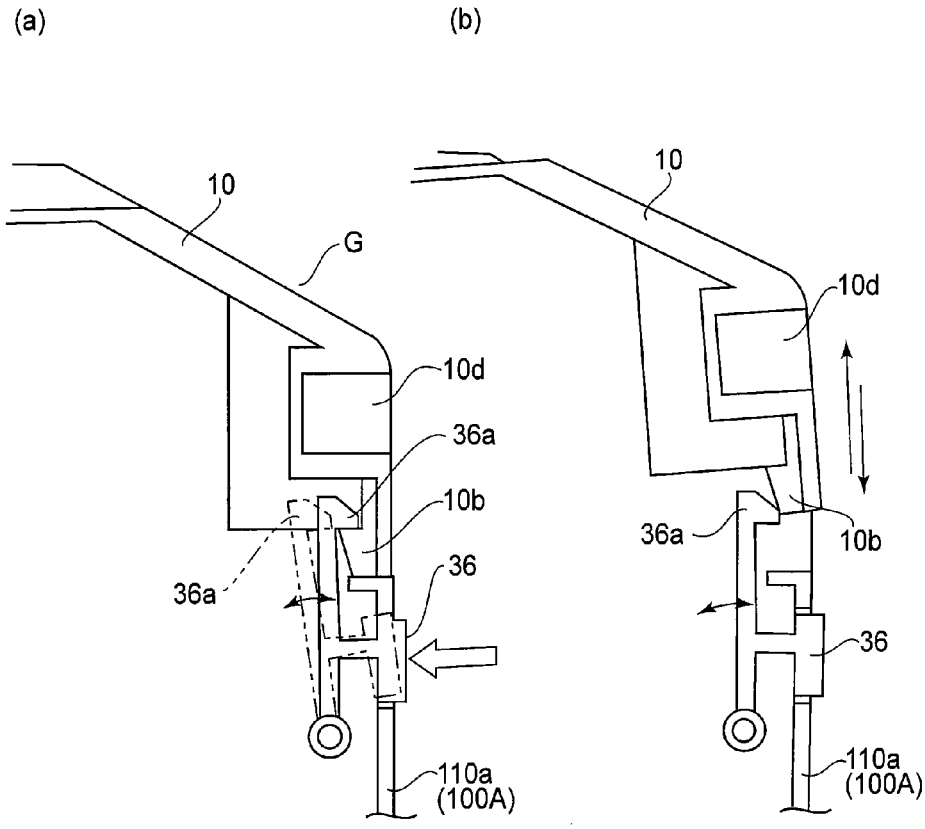

FIG. 9 is an illustration of a maintenance button.

Figure 10:
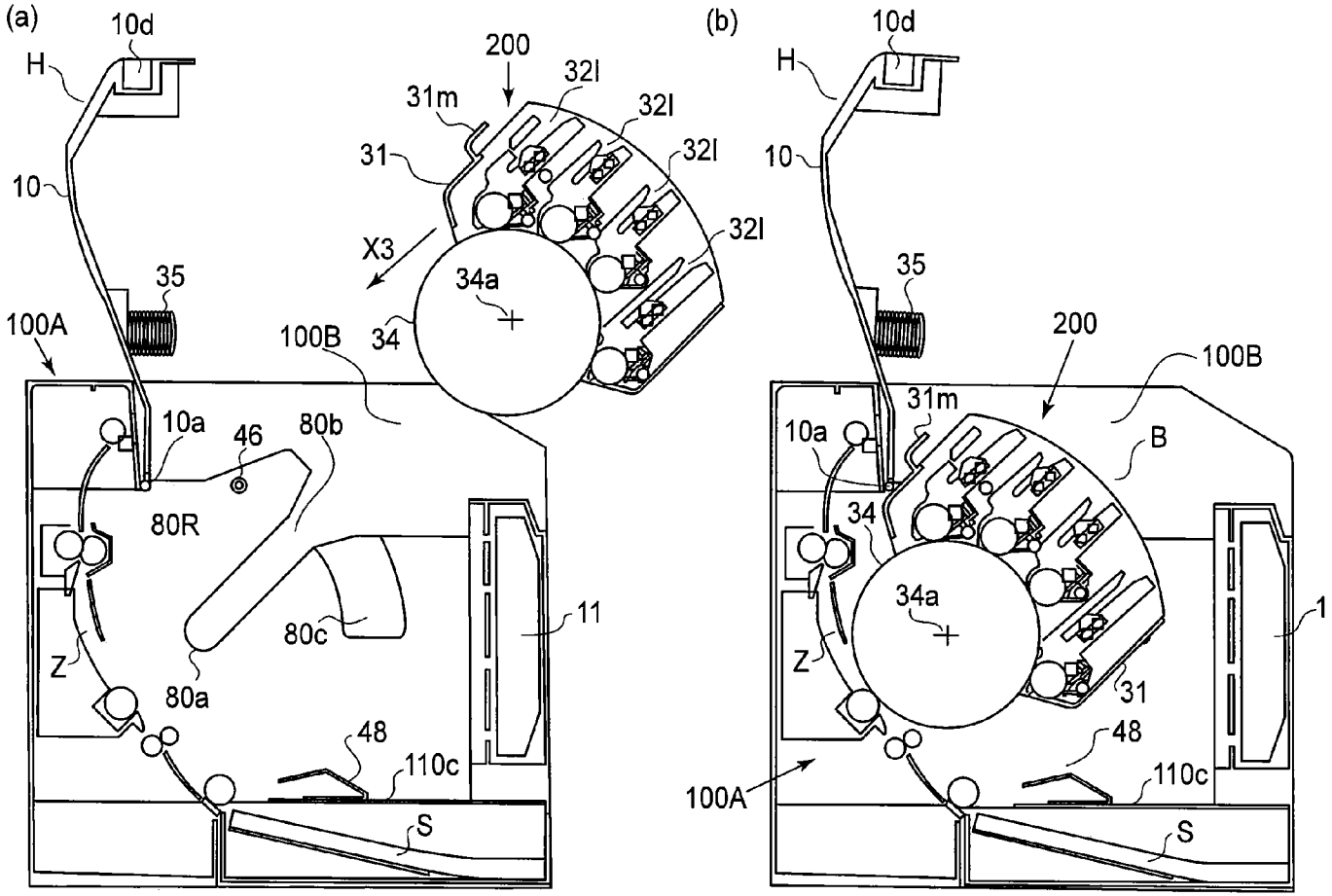

FIG. 10 is an illustration of the mounting process of the image forming unit relative to the main assembly.

Figure 11A:
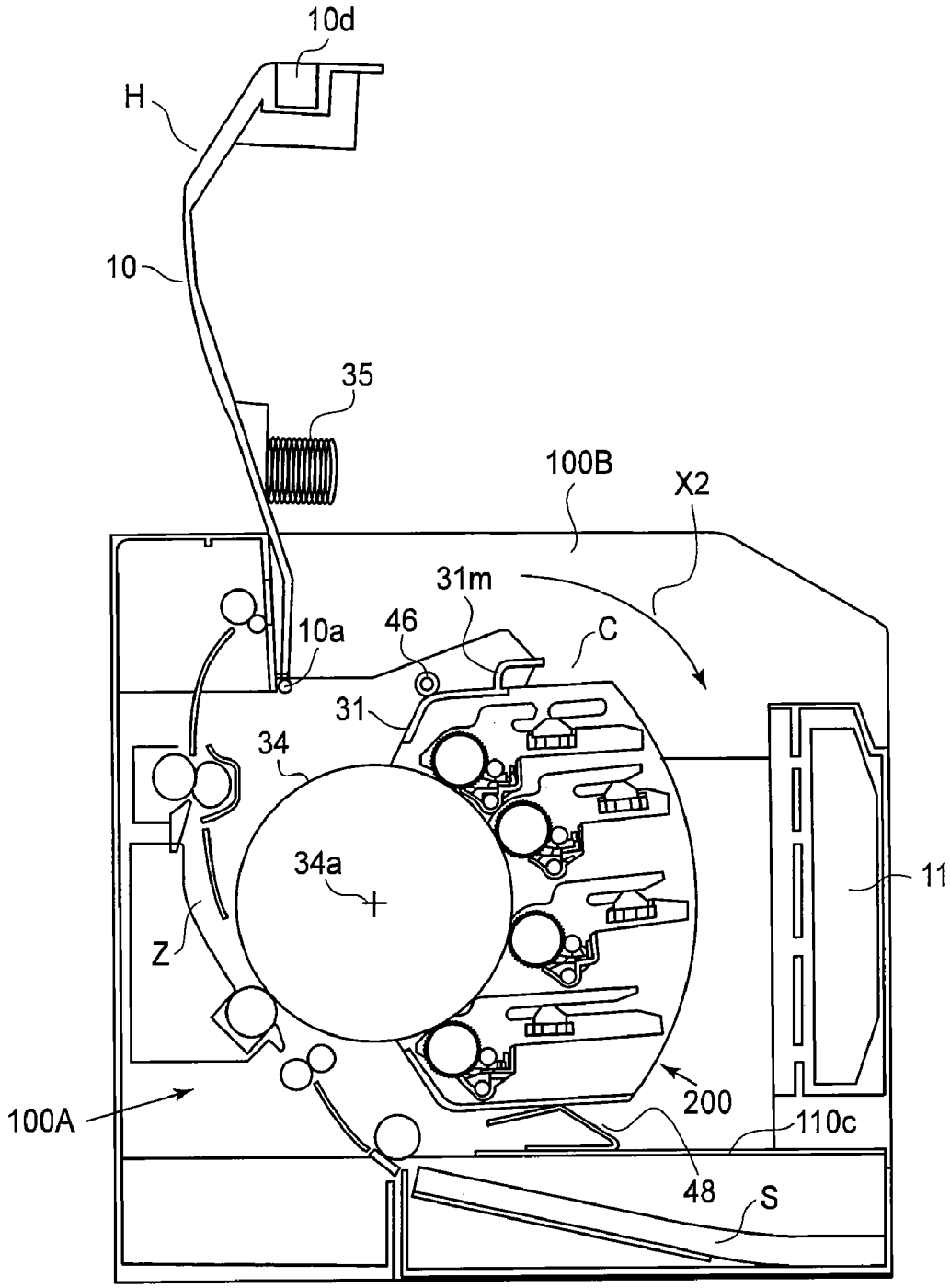
Figure 11B:
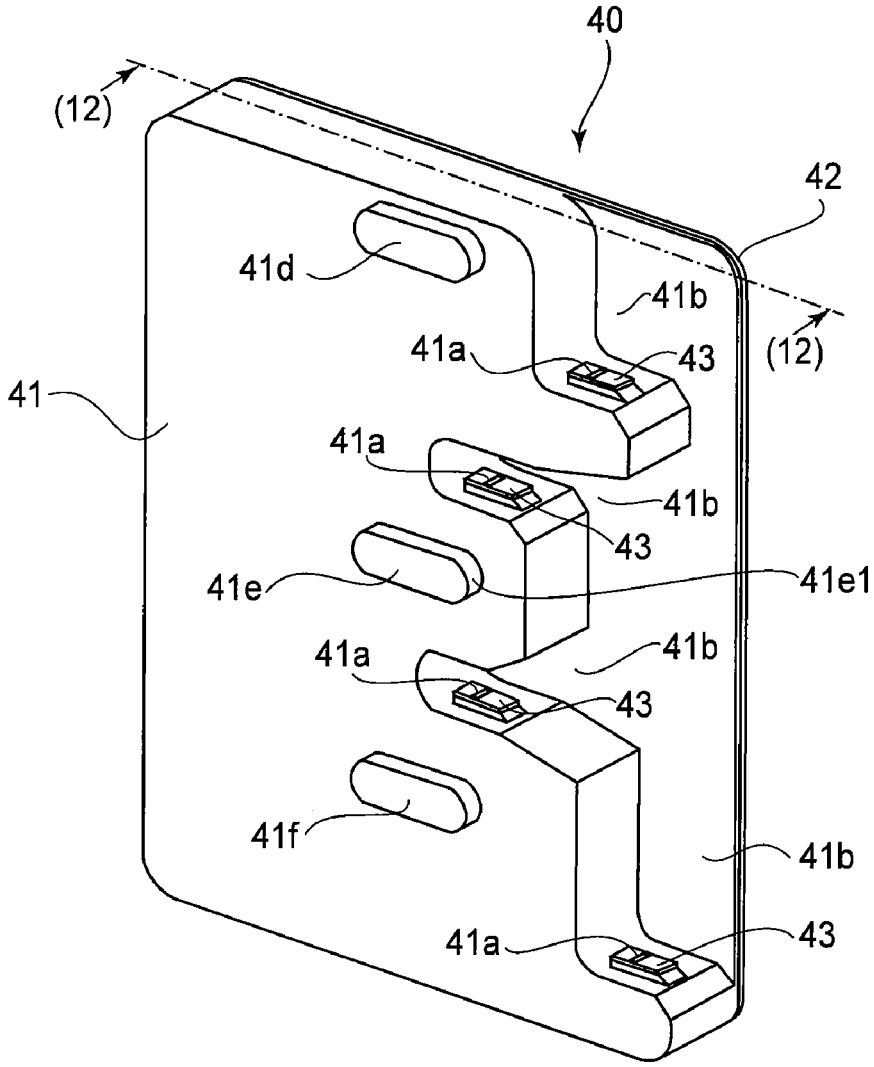

FIG. 11A is an illustration of the mounting of the image forming unit to the main assembly, and FIG. 11B is a right-hand side perspective view of the residual developer container.

Figure 12:
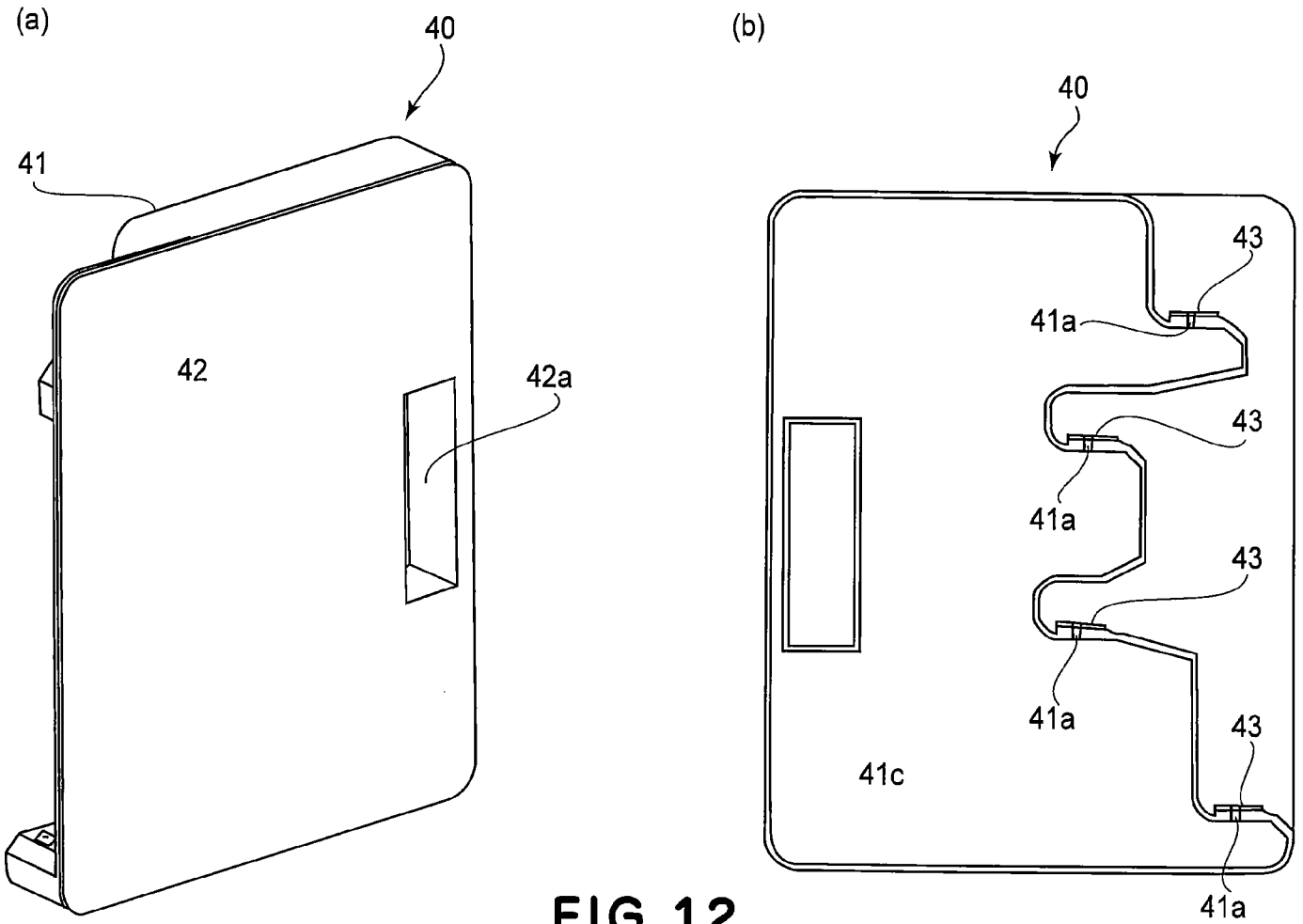

Part (*a*) of FIG. 12 is a left-hand side perspective view of the residual developer container, and (*b*) is a sectional view taken along the line (12)-(12) of FIG. 11B.

Figure 13:
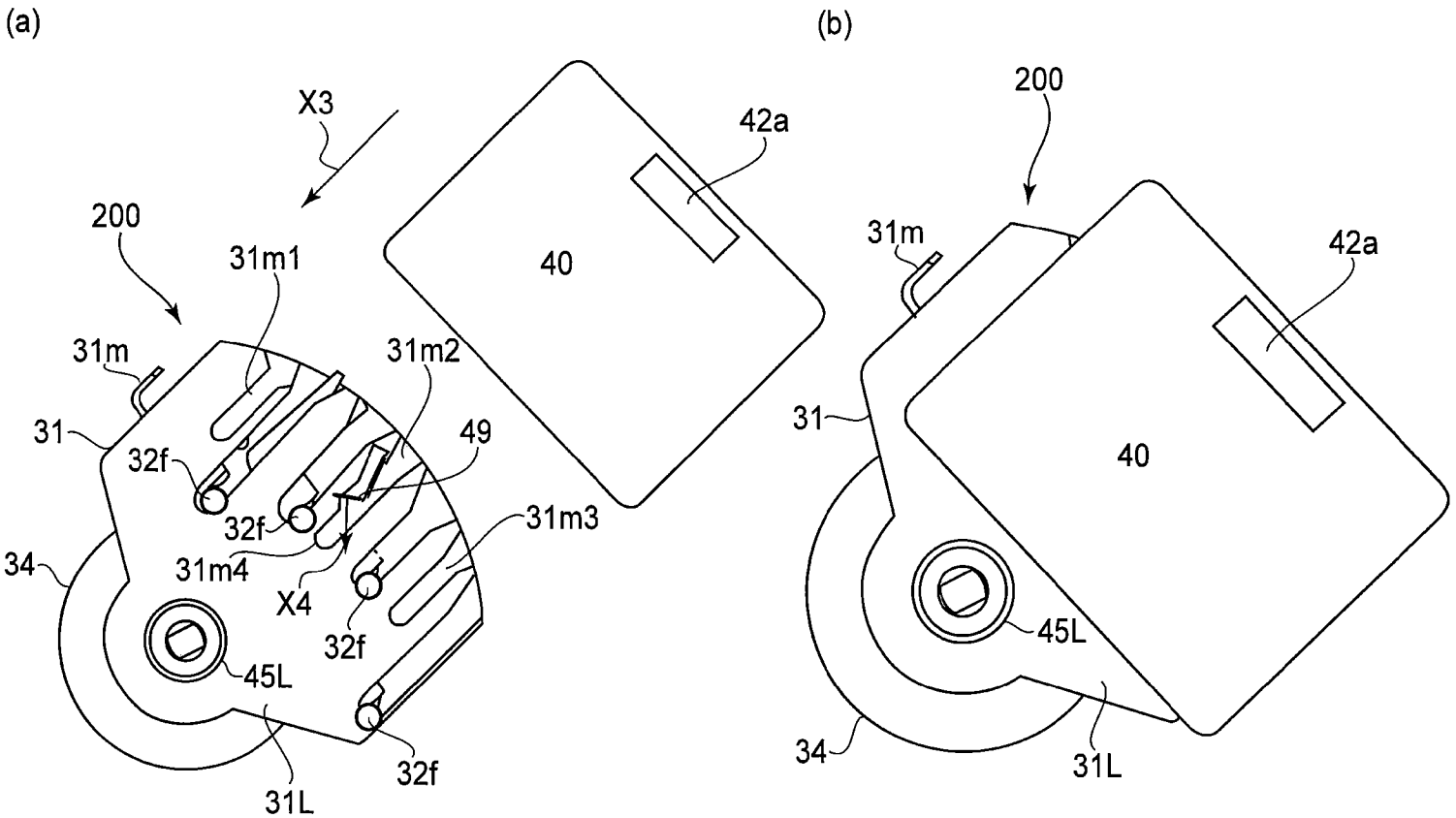

FIG. 13 is an illustration of a mounting process and demounting of the residual developer container relative to the image forming unit.

Figure 14A:
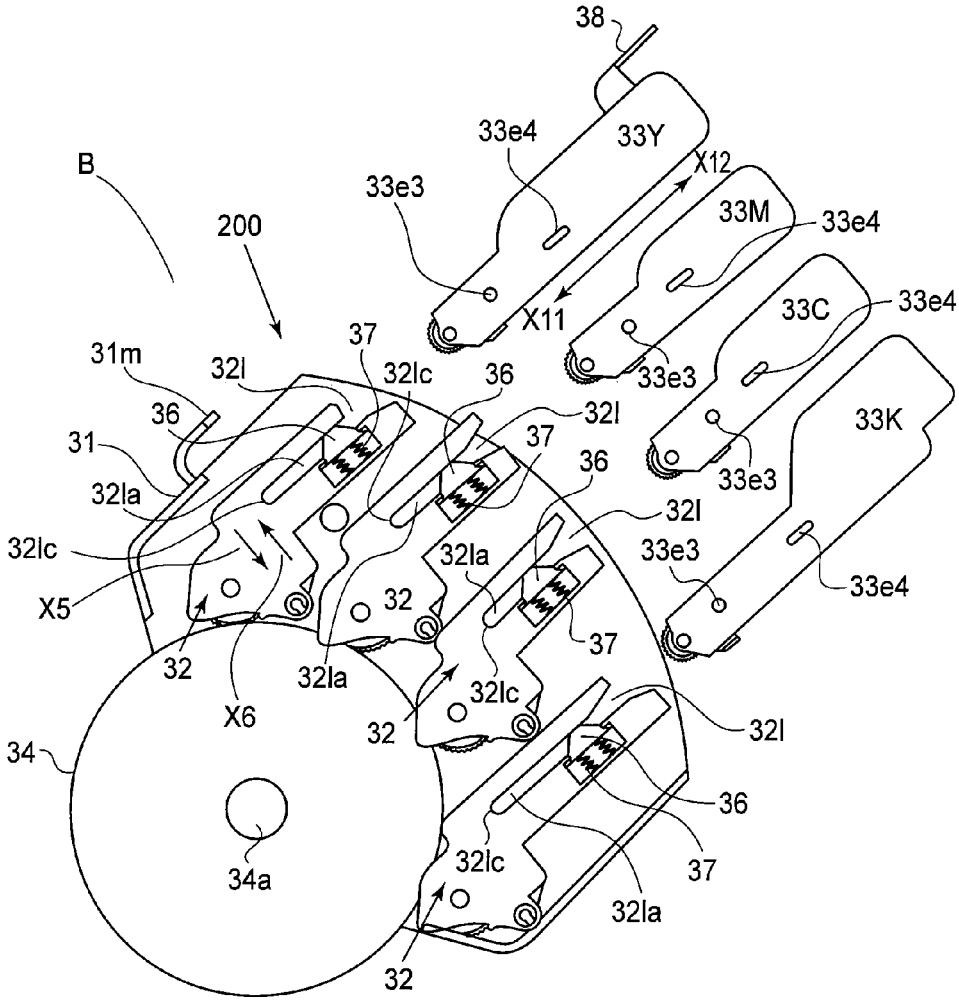
Figure 14B:
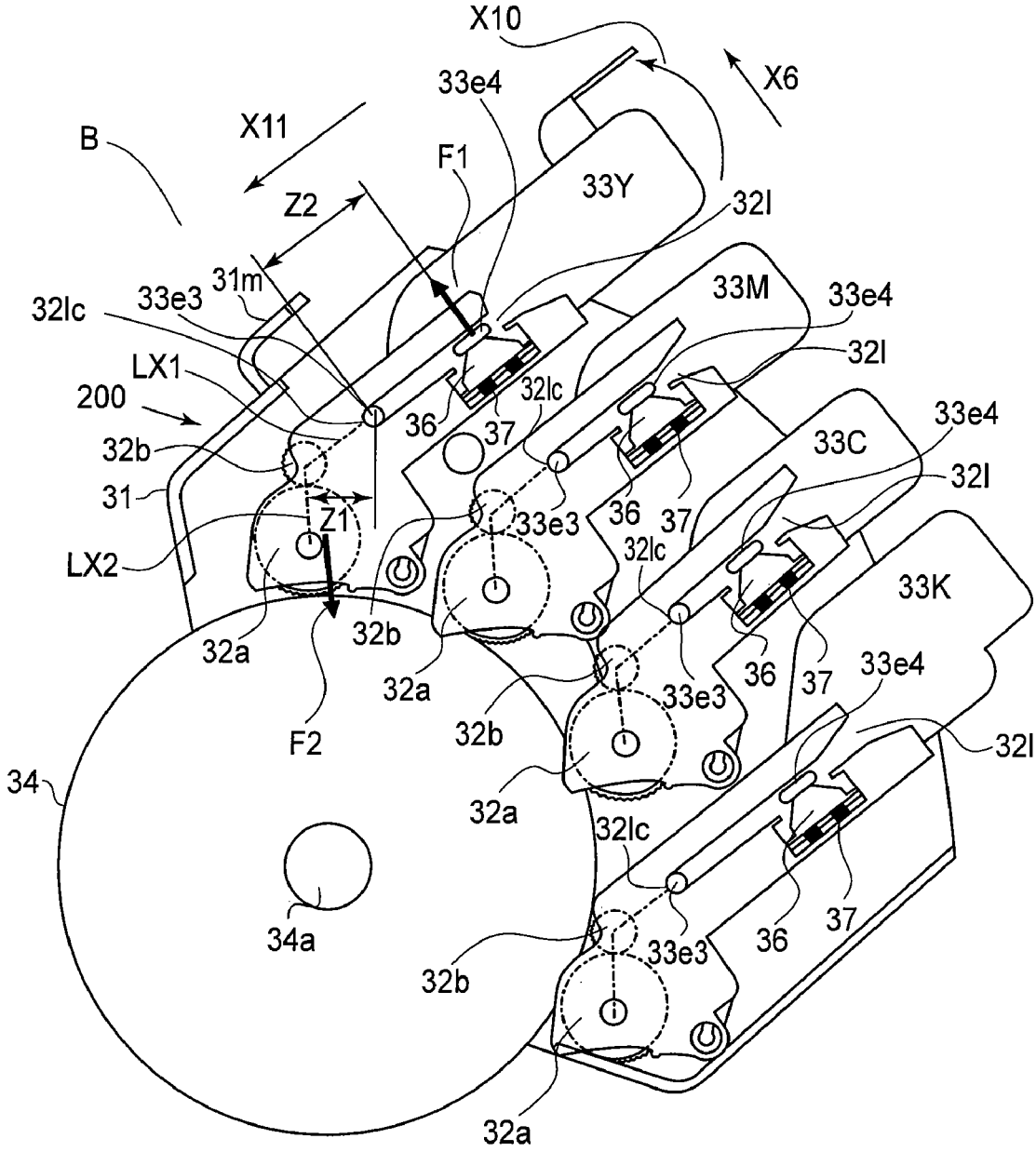

FIGS. 14A and 14B are illustrations of the mounting and demounting process of the cartridge relative to the image forming unit.

Figure 15A:
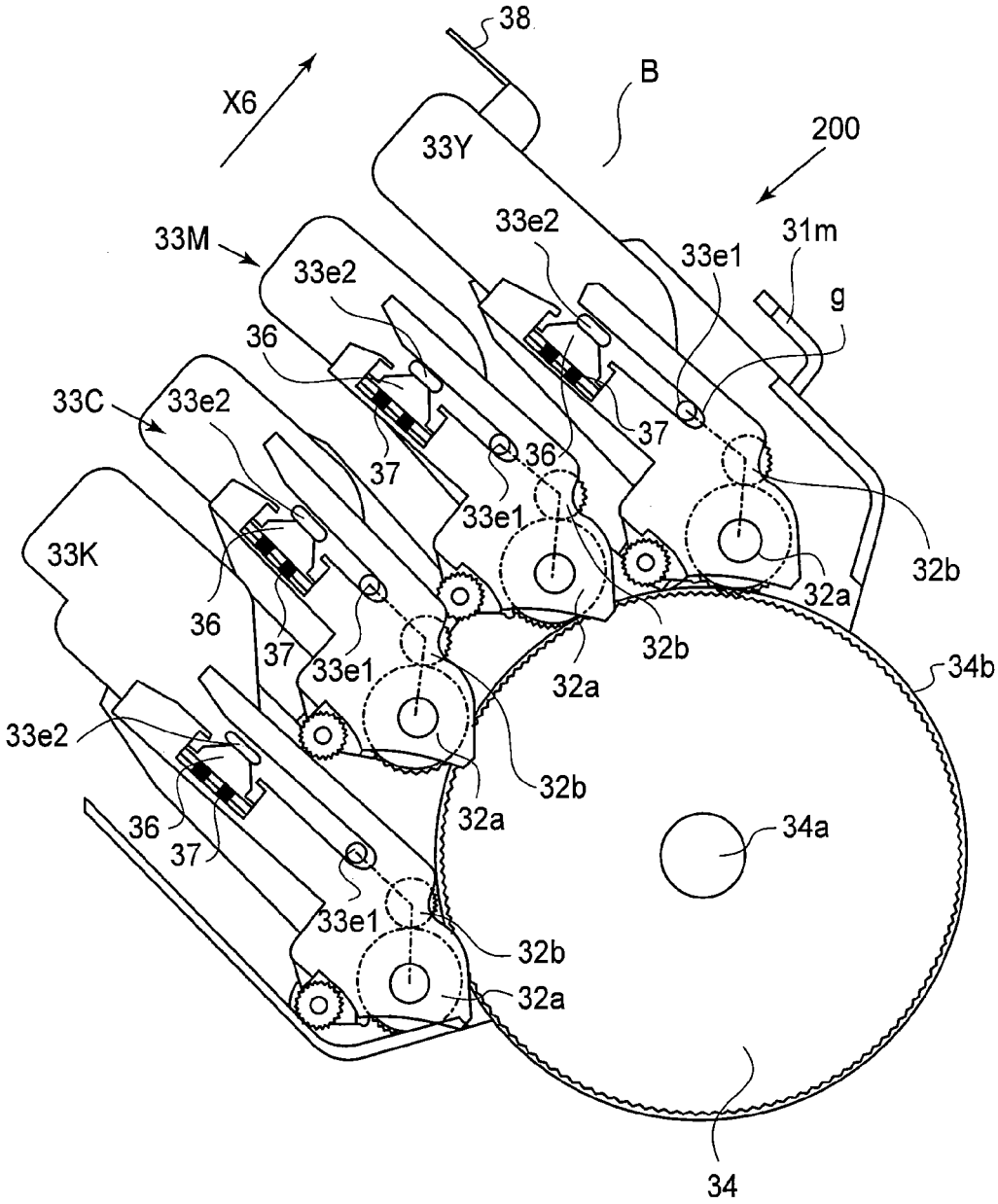
Figure 15B:
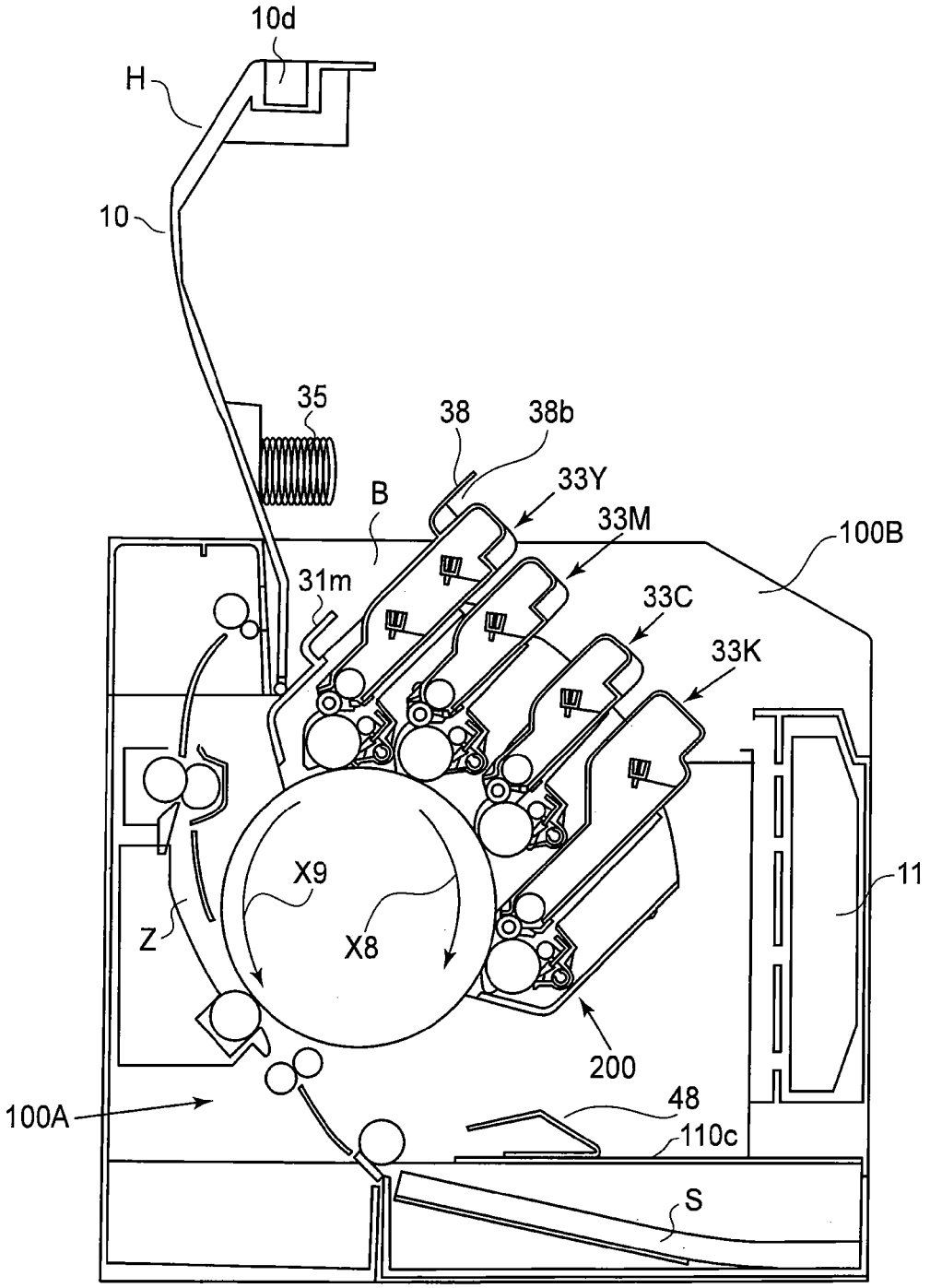

FIGS. 15A and 15B are illustrations of the mounting and demounting process of the cartridge relative to the image forming unit.

Figure 16A:
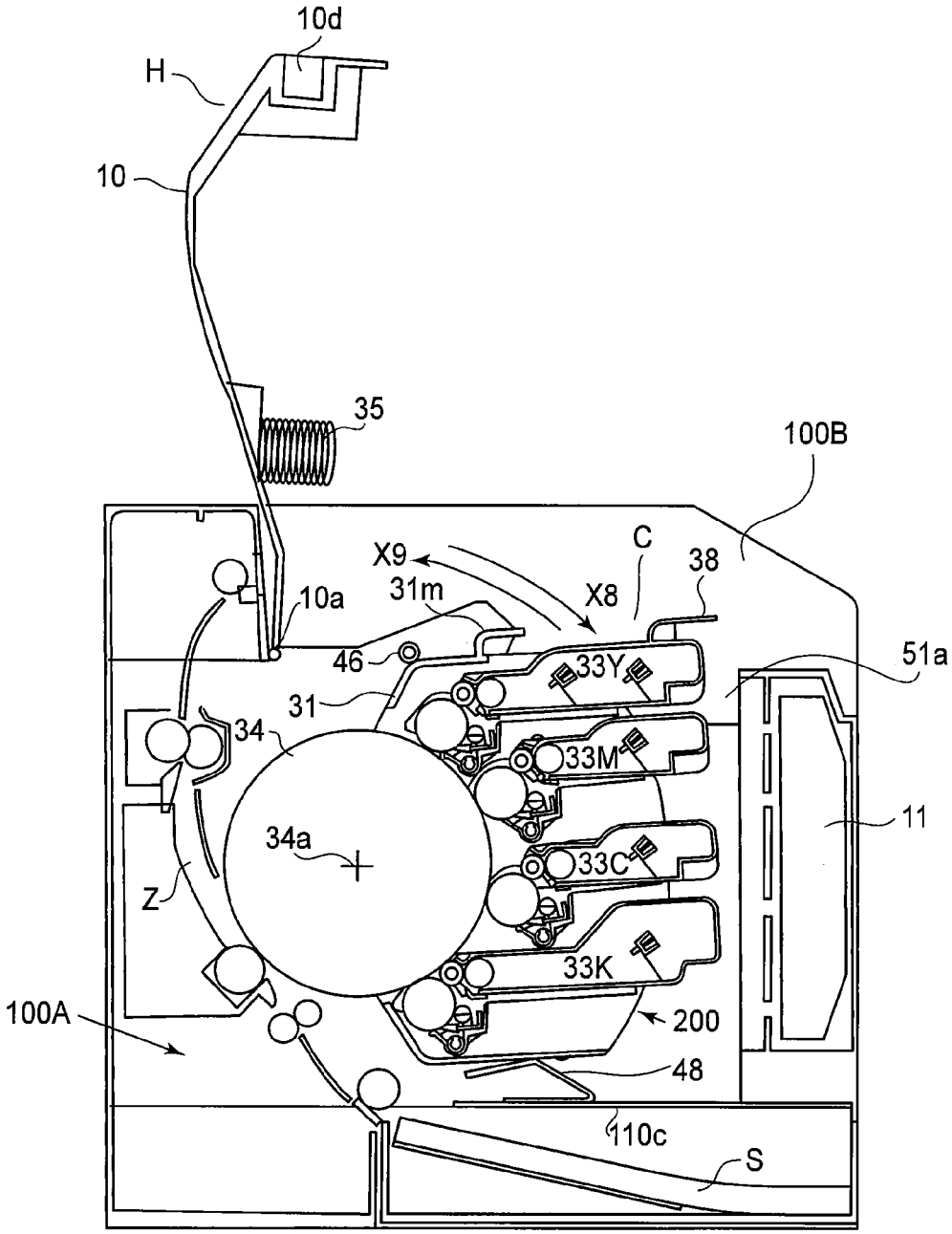
Figure 16B:
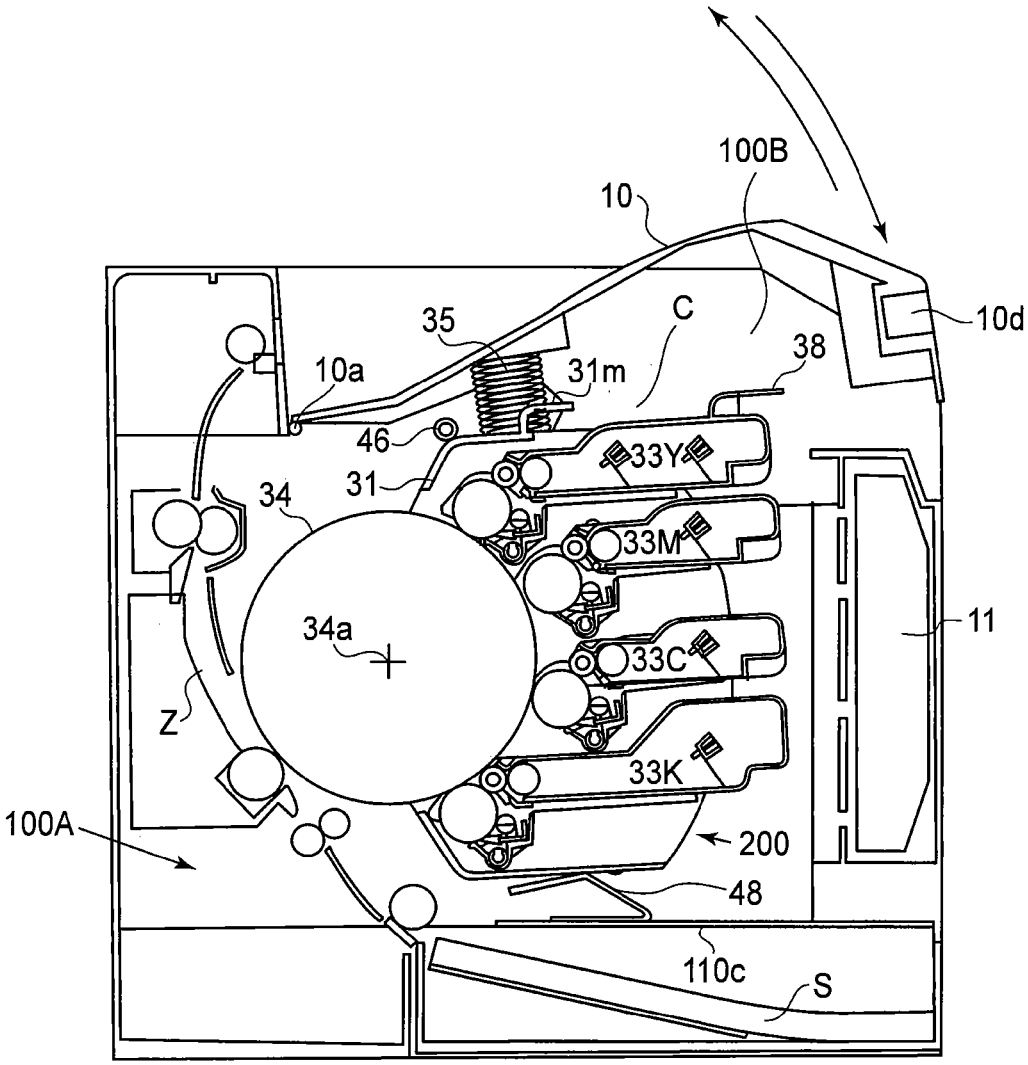

FIGS. 16A and 16B are illustrations of the mounting and demounting process of the cartridge relative to the image forming unit.

Figure 17:
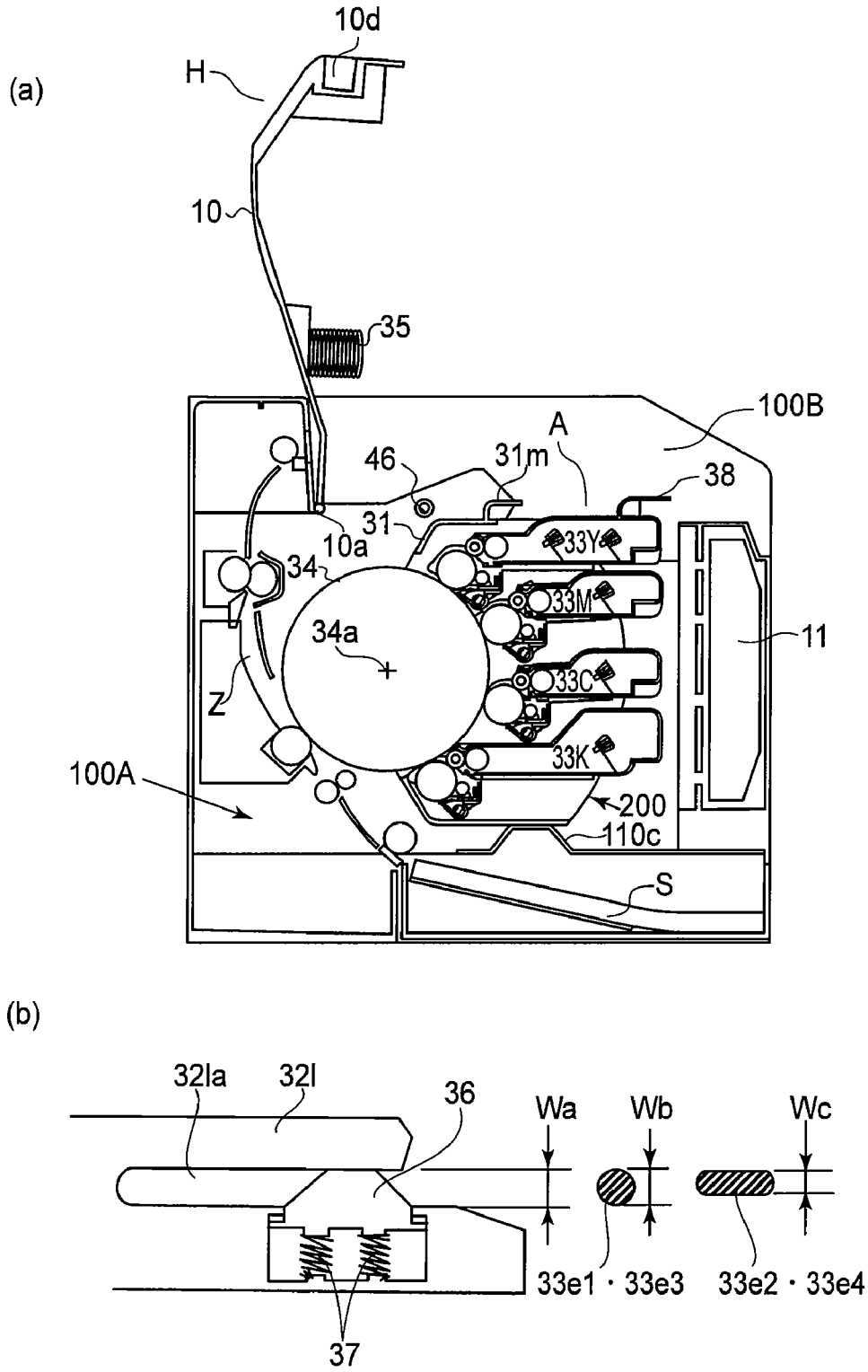

Part (*a*) of FIG. 17 is an illustration of the process of the mounting and demounting of the cartridge relative to the (*a*) image forming unit, and (*b*) shows a relation among the widths of a recess of a mounting portion, a force receiving portion, and a portion-to-be-guided.

DESCRIPTION OF THE PREFERRED EMBODIMENTS

The preferred embodiments of the present invention will be described in conjunction with the accompanying drawings. The dimensions, the materials, the configurations, the relative positions, and so on of the constituent parts which will be described hereinafter maybe properly changed by one skilled in the art depending on the structures and the various conditions of a device to which this invention is applied, and the scope of this invention is not limited to specific dimensions, materials, configurations, relative positions and so on of the embodiments which will be described below.

Figure 1A:
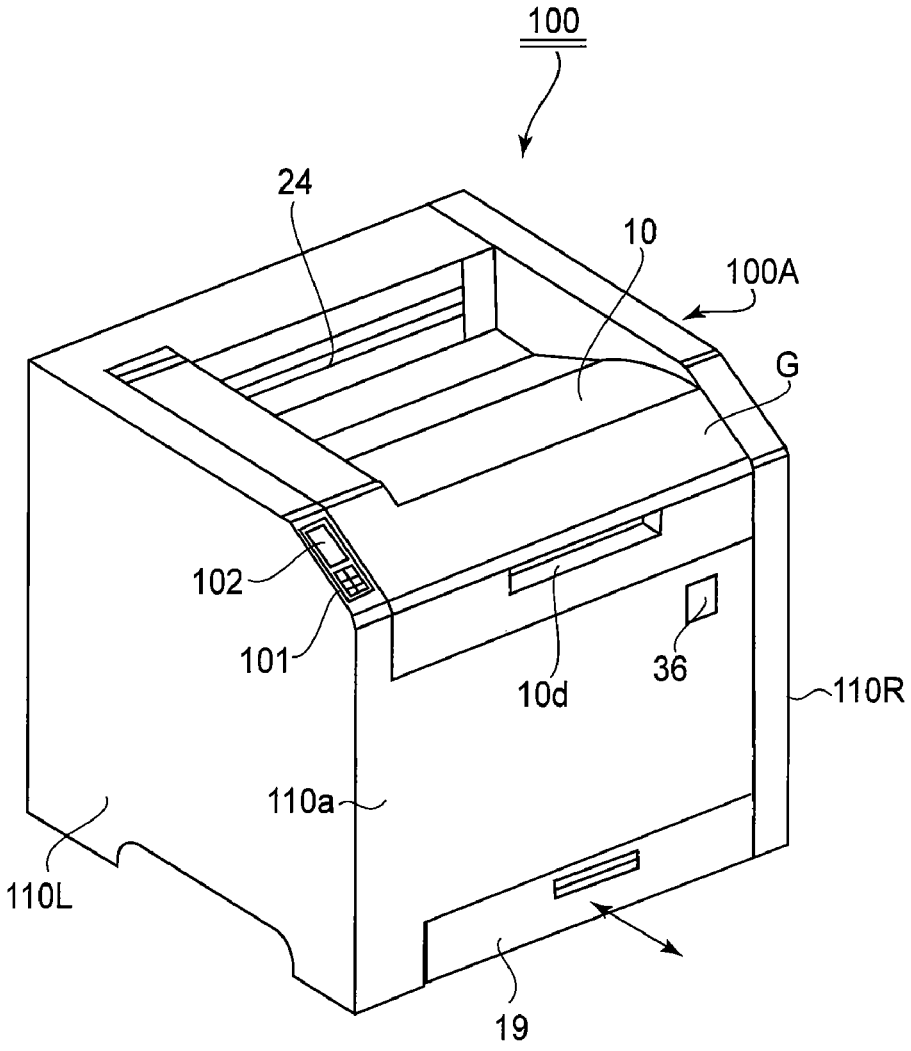
FIG. 1A is an outer appearance perspective view of an image forming apparatus of Embodiment 1.
Figure 1B:
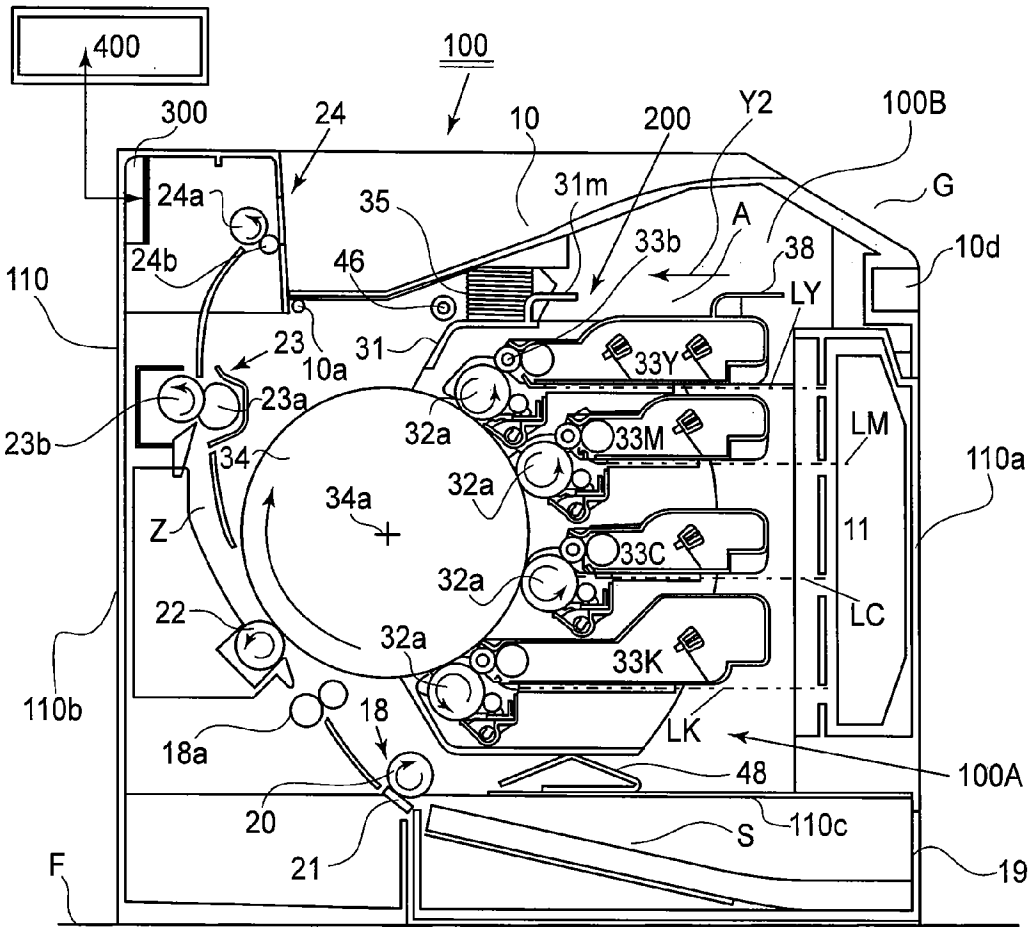
FIG. 1B is a left sectional view of the image forming apparatus.

The embodiment (general arrangement of color electrophotographic image forming apparatus) FIG. 1A is an outer appearance perspective view of an electrophotographic image forming apparatus (image forming apparatus) 100 in this embodiment. FIG. 1B is a left side longitudinal sectional view of the image forming apparatus 100. The image forming apparatus 100 is a laser printer of a full-color (four color) type which uses the electrophotographic process. The image forming apparatus 100 forms a full-color image on a recording material (sheet) S on the basis of the electrical image signal inputted to a control circuit portion 300 from an external host device 400 such as a personal computer, an image reader, a receiving part of a facsimile device.

In the following descriptions, relating to the image forming apparatus 100 a front side is the side in which a feeding cassette 19 for stacking and accommodating recording materials S is drawn out of an inside of a main assembly 100A to an outside. A backside is the opposite side from it. An upper side is the side in which a maintenance cover 10 is opened. Front-rear directions are a direction to the front side from the backside of the image forming apparatus and the reverse direction thereof. The left and right are the left and right, as seen from the front side of the image forming apparatus. The left-right directions are a direction to the left from the right, and the reverse direction thereof. A longitudinal direction is a direction of an axis of an electrophotographic photosensitive drum or a developing roller. The main assembly 100A is portions of the image forming apparatus other than the cartridges 33 (33Y, 33M, 33C and 33K) and an image forming unit 200. In the image forming apparatus of this embodiment, a right-hand side is a driving side, and a left-hand side is the non-driving side.

Figure 2:
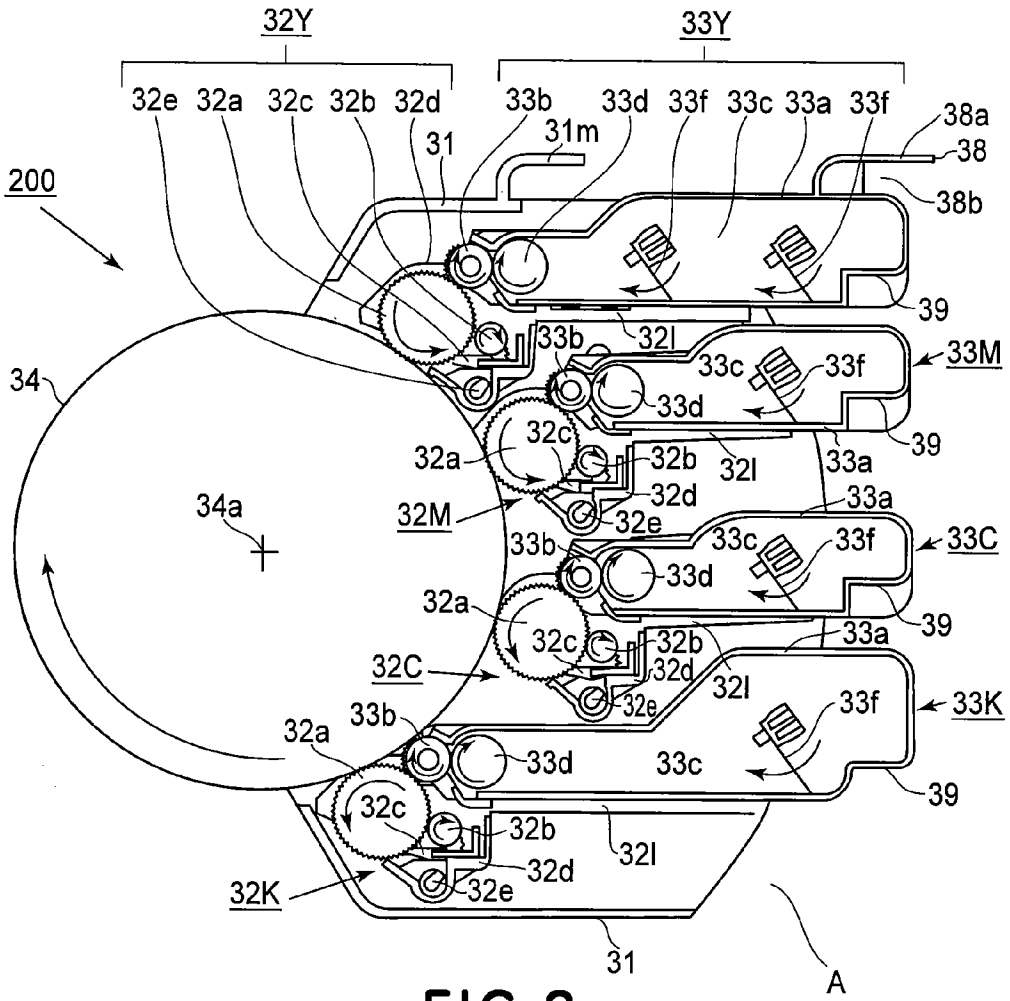
FIG. 2 is an enlarged view of an image forming unit part of (*b*) of FIG. 1.

The image forming apparatus 100 is placed on a substantially horizontal installation surface F such as a mounting base, the desk or the floor. A central portion in the main assembly 100A is provided with the image forming unit 200. FIG. 2 is an enlarged view of the image forming unit 200 shown in FIG. 1B. A unit 200 is provided with the cartridge mounting portion (mounting guide) 32*l* for dismountably mounting a plurality of cartridges in (present embodiment, the first-fourth developing cartridges 33 (33Y, 33M, 33C and 33K)) and a single intermediary transfer member (transfer member) 34. In this embodiment, an electrophotographic photosensitive drum 32*a* corresponding to the developing cartridge 33 is mounted to the unit 200 as parts of a photosensitive member unit 32 (32Y, 32M, 32C, 32K) with a charging roller 32*b* and a cleaning blade 32*c*. The charging roller 32*b* and the cleaning blade 32*c* are process means. In the image forming apparatus 100, a plurality of cartridges 33 are dismountably mounted to main assembly 100A (unit 200), and a color image is formed on recording material S. The unit 200 will be described in detail hereinafter. In this embodiment, the cartridges 33 have the similar structures, except for the colors of the contained powdery developers (toner). However, they are not limited to this example. For example, a developing cartridge 33K which accommodates a black developer may have a larger capacity developer accommodating portion 33*c* than the developing cartridges 33 which accommodate the developers of the other colors. In this embodiment, the cartridge is a developing cartridge, although the present invention is not limited to this.

(Photosensitive Member Unit)

Each of the units 32 (32Y, 32M, 32C and 32K) is fixed to a sub-frame 31 of the image forming unit 200. Each unit 32 includes the drum 32*a*. The unit 32 includes the charging roller 32*b* and the cleaning blade 32*c* for removing the developer which remained on the surface of the drum 32*a*, as the process means which acts on the drum 32*a*. The feeding screw (feeding member) 32*e* for feeding, in the axial direction of the drum 32*a*, the developer removed by the cleaning blade 32*c* is provided. The drum 32*a*, the charging roller 32*b*, the cleaning blade 32*c*, and the feeding screw 32*e* is disposed with a predetermined arrangement relation relative to a photosensitive member case 32*d*.

Par (*a*) of FIG. 3 is a perspective view of a unit 32Y, as seen from left-hand side. Part (*b*) of FIG. 3 is a perspective view of a photosensitive member case 32*d* excluding the drum 32*a*, the charging roller 32*b*, and the cleaning blade 32*c* from the unit 32M of (*a*) of FIG. 3. Part (*a*) of FIG. 4 is a perspective view of the case 32*d* of (*b*) of FIG. 3, as seen from a right-hand side, and (*b*) is an enlarged vertical longitudinal sectional view of a removed developer discharging portion 32*f* of the case 32*d*. The other units 32M, 32C and 32K have substantially the same structures, and therefore, the description will be made as to the photosensitive member unit 32Y. A right-hand end portion and a left-hand end portion of the case 32*d* are provided with the bearing portions 32*d*1 and 32*d* which comprise through-holes, respectively, which support the drum 32*a* rotatably. The insides of the bearing portions 32*d*1 or 32*d*2 are provided with the end Sealing members 32*k*1, 32*k*2 contacting the drum 32*a* and the sheet-like sealing members 32*h* extended in the axial direction of the drum 32*a*. The each of the sealing members 32*k*1, 32*k*2 and 32*h* contacts to the surface of the drum 32*a*, so that the developer in the case 32*d* does not leak to an outside. Inside the case 32*d*, a feeding screw 32*e* extended in the longitudinal direction is provided. The right-hand end portion of the screw 32*e* is provided with the feeding gear 32*i*, which receives a driving force from a drum gear 32*a*1 provided at the right-hand end portion of the drum 32*a* through an idler gear 32*j*. A removed developer in the case 32*d* is fed in the direction of the arrow X7 (leftward direction) by rotating operation of the screw 32*e*. The removed developer fed by the screw 32*e* is carried to the removed developer discharging portion 32*f* provided at the left-hand end portion of the screw 32*e*. The discharging portion 32*f* outwardly projects out of the left-hand end portion of the case 32*d*. The removed developer fed by the screw 32*e* is discharged to the outside through an opening 32*g*1 provided in the discharging portion 32*f*. The opening 32*g*1 is provided with a rotatable shutter 32*g*. The shutter 32*g* is rotatable between an open position for opening the opening 32*g*1 and a closing position for closing the opening 32*g*1. The shutter 32*g* is moved to the open position by the mounting operation, to the unit 200, of the residual developer container 40 (FIG. 11 to FIG. 13) as will be described hereinafter. By this, the removed developer in the case 32*d* can be discharged to the inside of the container 40. When the container 40 is not mounted, the shutter 32*g* is urged to the closed position by a spring (unshown), and therefore, the developer does not leak outwardly.

The right-hand end portion and the left-hand end portion of each unit 32 is provided with the mounting portion 32*l* for mounting the cartridge 33, and the mounting portions 32*l* are extended in the direction perpendicular to the axes of the drums 32*a*, respectively. A part of a mounting portion 32*l* is provided with a recess 32*la* for receiving the portions-to-be-guided (portions-to-be-regulated) 33*e*1 and 33*e*3 (FIG. 5) of the cartridge 33. Adjacent to the recess 32*la*, there are provided a force applying member 36 for applying the force toward the drum 32*a* to the cartridge 33 and an urging member 37 for urging the force applying member 36.

As has been described hereinbefore, by providing the feeding screw 32*e* for feeding the removed developer to the outside in each unit 32, it is not necessary to provide a space for containing the removed developer in the inside. Therefore, the unit 32 is downsized. In this embodiment, the unit 32 is fixed to the unit 200. Therefore, when drum 32*a* or the like is worn, the whole unit 200 is exchanged. However, the unit 32 may be detachably mountable to the unit 200, and in such a case, only the unit 32 is exchanged. (Cartridge)

As shown in FIG. 2, each of the cartridges 33 (33Y, 33M, 33C and 33K) is provided with a case 33*a* and the developing roller 33*b* for developing the electrostatic latent image formed on the drum 32*a* into the developer image by supplying the developer to the drum 32*a*. The cartridge 33 is provided with a developer accommodating portion 33*c* which accommodates the developer to be used for the development of the electrostatic latent image and a supplying roller 33*d* for supplying the developer from the developer accommodating portion 33*c* to the developing roller 33*b*. The developer accommodating portion 33*c* is provided with the feeding member 33*f* for feeding the inner developer to the supplying roller 33*d*. A first cartridge 33Y accommodates the (yellow Y) color developer in the developer accommodating portion 33*c*, and a Y color developer image is formed on the surface of the corresponding drum 32*a*. A second cartridge 33M accommodates the (magenta M) color developer in the developer accommodating portion 33*c*, and a M color developer image is formed on the surface of the corresponding drum 32*a*. A third cartridge 33C accommodates the (cyan C) color developer in the developer accommodating portion 33*c*, and a C color developer image is formed on the surface of the corresponding drum 32*a*. A fourth cartridge 33K accommodates the (black K) color developer in the developer accommodating portion 33*c*, and a K color developer image is formed on the surface of the corresponding drum 32*a*.

Part (*a*) of FIG. 5 is a perspective view of the cartridge 33Y, as seen from right-hand side, and (*b*) is a perspective view of that, as seen from left-hand side. The cartridges 33 will be described as to the case of this cartridge 33Y. The cartridge 33Y is mounted in the direction of the arrow X11 to the mounting portion 32*l* of the unit 200. The cartridge 33Y is dismounted from the mounting portion 32*l* of the unit 200 in the direction of the arrow X12 opposite to the arrow X11. The cartridge 33Y is provided with the developing roller 33*b* in a leading end with respect to the mounting direction. The right-hand end portion of the developing roller 33*b* is provided with a gear 50, which receives the driving force from the drum gear 32*a*1 to rotate the developing roller 33*b*. The gear 50 transmits the driving force to the supplying roller 33*d* and the feeding member 33*e* through a gear train (unshown). The opposite ends of the developing roller 33*b* are provided with spacers 51 which contact with the surface of the drum 32*a* and which regulate a distance between the developing roller 33*b* and the drum 32*a*. The each of the right-hand end portion and the left-hand end portion of the cartridge 33Y is provided with the portions-to-be-guided 33*e*1 and 33*e*3 for being guided by the unit 200, when the cartridge 33Y is mounted to the unit 200. The portions-to-be-guided 33*e*1 and 33*e*3 each have a cylindrical shape and project toward the outside of the right-hand end portion and toward the outside of the left-hand end portion of the cartridge 33Y. A back of the portion-to-be-guided, 33*e*1, 33*e*3, the (a upstream side of the portion-to-be-guided, 33*e*1, 33*e*3 with respect to a cartridge mounting direction X11) which is provided with the force receiving member 33*e*2, 33*e*4 for receiving the force from the force applying member 36 provided on the unit 32, described above. The force receiving portions 33*e*2 and 33*e*4 each have a substantially rectangular parallelepiped shape, and project toward the outside of the right-end portion and toward the outside of the left-end portion of the cartridge 33Y, and are extended in the direction perpendicular to the longitudinal direction of the cartridge 33. On the cartridge 33Y side opposite from the developing roller (33*b*) side, a first grip 39 (FIG. 2) for griping the cartridge 33Y formed by recessing the bottom plate of the case 33*a* out is provided. The cartridge 33Y is provided at an upper portion with a first grip 38 for gripping the cartridge 33Y. While griping the first grip 39 and the second flat surface portion 38*a* of the grip 38, a user mounts and demounts the cartridge 33Y relative to the unit 200. While griping the second grip 38, the user can mount and demount the cartridge 33Y relative to the unit 200. As has been described in the foregoing, the cartridge 33Y is provided with a first grip 39 and a second grip 38. The other cartridges PM, PC and PK have only the first grip 39. The user can mount and demount the other cartridges PM, PC and PK relative to the unit 200, while gripping the first grip 39 and the top surface portion of the case 33*a*.

In this embodiment, an intermediary transfer member 34 is rotatable about the substantially horizontal axis of the rotation axis 34*a*, and it is a cylindrical drum. Each cartridge 33 is provided on a front side of the intermediary transfer member 34, and extends substantially parallel with the installation surface F of the main assembly 100A they are provided adjacent to each other with respect to the substantially vertical direction. In the image forming apparatus of this embodiment, the first cartridge 33Y takes a top most stage position, and the second cartridge 33M is placed therebelow. The third cartridge 33C is placed further below. The fourth cartridge 33K takes the bottommost stage position. The developing roller 33*b* of each cartridge 33 may be in contact to the drum 32*a* (contact type developing system) or, it may be spaced with the predetermined small gap (predetermined distance) from the drum 32*a* (non-contact developing system).

(Scanner Unit)

Referring to FIG. 1, the front part of the front side of each cartridge 33 is provided with a laser scanner unit 11 as an image exposure device. The unit 11 is provided between a front frame 110*a* of a main frame 110 which is a frame of the main assembly 100A and each cartridge 33 in the main assembly 100A. The unit 11 includes a laser diode, a polygonal mirror, an Fθ lens, a reflection mirror, and so on. The unit 11 outputs laser beams L (LY, LM, LC and LK) which are modulated correspondingly to the image information for the Y, M, C and K color inputted to the control circuit portion 300 from the external host device 400 to scan the drums 32*a* of the cartridges 33 for the corresponding colors (image exposure).

(Recording Material Feeding Mechanism)

A lower part of the unit 200 is provided with a feeding unit 18. The unit 18 includes a feeding cassette 19 for stacking recording material S, a feeding roller 20, a separation pad 21, and so on. The cassette 19 is insertable and extractable in the front side of the main assembly 100A (front loading). In the main assembly 100A, between the transfer member 34 and a rear frame 110*b* of the main assembly 100A, there is provided a recording material feeding path Z extended from the feeding roller 20 to the upper rear portion in the main assembly 100A. A registration roller couple 18*a*, a secondary transfer roller 22, a fixing device 23, and a discharging roller pair 24 is provided along feeding path Z in this order upwardly. The fixing device 23 includes a fixing film unit 23*a* and a pressing roller 23*b*. The discharging roller pair 24 includes a discharging roller 24*a* and a discharging roller 24*b*. An upper surface of the main assembly 100A is provided with a maintenance cover 10 which functions as a discharging tray for receiving a recording material S on which the image has been formed. The cover 10 opens and closes an opening 100B provided in the upper surface of the main assembly 100A (opening and closing member). As will be described hereinafter, the opening portion 100B is an opening for mounting and demounting the cartridge 33 relative to the unit 200 placed in mounting and dismounting position B ((*b*) of FIG. 10, FIG. 14 and FIG. 15).

FIG. 1B shows the state that the image forming apparatus is capable of image forming operation 100. In this state, the cover 10 is placed in the closed position G for closing the opening portion 100B. The unit 200 is loaded with each cartridge 33, and is placed in an image forming position A for carrying out an image formation relative to the main assembly 100A. A gear (drive inputting portion) 34*b* (FIG. 6) of the transfer member 34 is in engagement with a drive outputting portion (unshown) provided in the main assembly (100A) side. An electric power supply system (unshown) provided in the main assembly (100A) is electrically connected to an electrical contact (unshown) of each unit 32 and cartridge 33. Here, the driving system and the bias voltage application type described above can employ the structure similar to the case of the normal image forming apparatus, although not shown in the Figure for the sake of simplicity.

The operation for forming a full-color image will be described. Referring to FIG. 1(*b*) and FIG. 2, each drum 32*a* is rotationally driven in the counter-clockwise direction indicated by the arrow at a predetermined speed. The charging roller 32*b* is rotated by the rotation of the drum 32*a*. The transfer member 34 is rotationally driven at the speed corresponding to the speed of the drum 32*a* in the clockwise direction (codirectional with the rotation of the drum 32*a*) of the arrow. The developing roller 33*b* and the supplying roller 33*d* are rotationally driven at the predetermined speeds in the clockwise directions of the arrows, respectively. The scanner unit 11 also is driven. In synchronism with this drive, a predetermined charging bias voltage is applied to each charging roller 32*b* at predetermined control timing. By this, the surface of each of the drum 32*a* is uniformly charged by the charging roller 32*b* to the predetermined polarity and predetermined potential. The scanner unit 11 scanningly exposes the surface of each drum 32*a* to the laser beams L (LY, LM, LC and LK) modulated in accordance with the corresponding Y, M, C and K image signals. By this, the electrostatic latent image corresponding to the correspondence color image signals is formed on the surface of the drum 32*a* of each cartridge P. The electrostatic latent image formed on the surface of each drum 32*a* is developed into the developer image by the developing roller 33*b* of the corresponding cartridge 33. The developing roller 33*b* is supplied with a predetermined developing bias voltage at the predetermined controlled timing. Through the above-described electrophotographic image forming process operation, a Y color developer image corresponding to a yellow component of the full-color image is formed on the drum 32*a* opposed by a cartridge 33Y. The developer image is transferred (primary transfer) onto the transfer member 34 in a primary transfer nip which is the contact portion between the drum 32*a* and the intermediary transfer member 34. An M color developer image corresponding to a magenta component of the full-color image is formed on the drum 32*a* opposed by a cartridge 33M. The developer image is transferred (primary transfer) onto the transfer member 34 in a primary transfer nip which is the contact portion between the drum 32*a* and the transfer member 34 superimposedly on the already transferred Y color developer image. A C color developer image corresponding to a cyan component of the full-color image is formed on the drum 32*a* opposed by a cartridge 33C. The developer image is transferred (primary transfer) onto the transfer member 34 in the primary transfer nip which is the contact portion between the drum 32*a* and the transfer member 34 superimposedly on the already transferred Y color +M color developer image. A K color developer image corresponding to a black component of the full-color image is formed on the drum 32*a* which the cartridge 33K opposed. The developer image is transferred (primary transfer) onto the transfer member 34 in the primary transfer nip which is the contact portion between the drum 32*a* and the transfer member 34 superimposedly on the already transferred Y color +M color +C color developer images. In this way, a full-color developer image of the Y color +M color +C color +K color is synthetically formed on the transfer member 34. An order of the colors of the developer images transferred is not limited to the above described order. In each of the untransferred developer remaining on the drum surface after the primary transfer of the developer image relative to the transfer member 34 is removed by the cleaning blade 32*c*. The removed developer is fed to residual developer container 40((*b*) of FIG. 13) through the feeding screw 32*e*.

On the other hand, the feeding roller 20 is driven at the predetermined controlled timing. In this manner, by a cooperation of the feeding roller 20 and the separation pad 21, the separation and feeding of the sheet-like recording materials S stacked in the cassette 19 is carried out one by one. The recording material S is introduced into the secondary transfer nip which is the contact portion between the transfer member 34 and the secondary transfer roller 22, at the predetermined controlled timing by the registration roller couple 18*a*. The transfer roller 22 is supplied with the secondary transfer bias voltage of the predetermined potential having the polarity opposite to that of the charge polarity of the developer at the predetermined controlled timing. By this, while the recording material S is nipped and fed by the transfer nip, the developer image on the intermediary transfer member 34 on which it is superimposed is sequentially transferred (secondary transfer) onto the surface of recording material S. The recording material S which has passed through the secondary transfer nip is separated from the surface of the transfer member 34 and it is introduced to the fixing device 23, where it is heated and pressed by a fixing nip. By this, the color developer images are mixed and fixed on recording material S. The recording material S is discharged out of the fixing device 23, and is discharged on the cover 10 which functions as a discharging tray by discharging roller pair 24 as a full-color print. The toner remaining after the secondary transfer remaining on the surface of the transfer member 34 after the separation of the recording material S from the transfer member 34 is removed. In the case of this embodiment, the toner is electrostatically deposited onto the surface of the drum 32*a* in the primary transfer nip 34*b* in the unit 32Y between the drum 32*a* and the transfer member 34, and, and then it is removed by the cleaning blade 32*c*.

The transfer member 34 is the rotatable member of a drum configuration. The different color developer images formed on the drums 32*a* is superimposedly transferred onto the transfer member 34. The developer images transferred superimposedly is transferred all together onto the recording material S from the transfer member 34. By this, the color image is formed on the recording material S. In the case where a monochromatic image is to be formed, the color developer image K formed on the drum 32*a* to which the cartridge 33K is opposed is transferred onto the transfer member 34. The transferred black developer image is transferred onto recording material S from the transfer member 34. By which a K color image is formed on the recording material S. In this embodiment, the secondary transfer roller 22 is movable between a first position in which it contacts to the transfer member 34 and forms the secondary transfer nip and a second position spaced from the transfer member 34 by a shifting mechanism (unshown). At the time of an image forming operation of the image forming apparatus 100, the secondary transfer roller 22 is moved to the first position, and at the time of then on-image formation, it is moved to the second position. The transfer roller 22 may normally be contacted with the intermediary transfer member 34.

(Image Forming Unit)

Referring to FIG. 6, the structure of the unit 200 will be described. Part (*a*) of FIG. 6 is a perspective view of the unit 200, as seen from left-hand side, and (*b*) is a perspective view, as seen from right-hand side. The unit 200 is provided with a sub-frame 31 detachably mountable relative to the main frame 110 of the main assembly 100A. The frame 31 supports the transfer member 34 which includes a cylindrical base member and an elastic member which coats the peripheral surface thereof rotatably. The transfer member 34 is rotatably supported at the left-hand end portion and the right-hand end portion of the center shaft (rotation shaft) 34*a* between a left side plate 31L and a right side plate 31R of the frame 31. A left shaft portion 45L and a right shaft portion 45R is fixed integrally to the outer surface of the side plates 31L, 31R coaxially with the center axis 34*a* of the transfer member 34. The right-hand end portion of the transfer member 34 is provided with a gear 34*b* which transmits the driving forces to the drums 32*a* to transmit the driving force transmitted from a main assembly driving source (unshown) to the drum gears 32*a*1. About the transfer member 34, the photosensitive member units 32 32Y, (32M, 32C and 32K) are disposed, so that the drums 32*a* are contacted to the transfer member 34. Each of the unit 32 is positioned relative to the frame 31 by a positioning structure (unshown), and is fixed by screws or the like thereto. By this, the drum 32*a* and the transfer member 34 of each unit 32 can be positioned relative to each other with high precision. Each drum 32*a* is in contact to the transfer member 34 with a predetermined urging force. Each unit 32 is inserted and fixed in the direction of the arrow X1 relative to the frame 31. At this time, the removed developer discharging portion 32*f* provided at the left-hand end portion of each unit 32 is inserted into the frame 31 through the associated opening portion 31*k* provided in the left side plate 31L of the frame 31. The removed developer discharging portion 32*f* is provided on the frame 31 in the state of projecting outwardly beyond the left side plate 31L. By the provision of the opening portion 31*k*, it can be mounted in the direction perpendicular to the axis of the drum 32*a*, even if the discharging portion 32*f* projects in the axial direction of the drum 32*a*. The right side plate 31R of the frame 31 is provided with the portion-to-be-regulated 31*l* for regulating a rotation of the unit 200 in the main assembly 100A. The unit 200 is positioned in the main assembly 100A by the left shaft portion 45L, the right shaft portion 45R, and the portion-to-be-regulated 31*l*. The details thereof will be described hereinafter. The left shaft portion 45L, the right shaft portion 45R, and a portion-to-be-regulated-in-rotation 31*l*, which are the positioning portions for the transfer member 34 in the main assembly 100A is commonly provided on the frame 31. By this, the position of the transfer member 34 in the main assembly 100A is determined with high precision. In order to rotate the unit 200 through a predetermined angle, a grip (second grip) 31*m* is provided in the upper portion of the frame 31. While griping the grip 31*m*, the user can rotate the unit 200 between the image forming position a ((*b*) of FIG. 1, and FIG. 2) for carrying out the image formation and the mounting and dismounting position B ((*b*) of FIG. 10, FIG. 14 and FIG. 15) for mounting and demounting the cartridge 33. The right side plate 31R of the frame 31 is provided with a portion-to-be-regulated-in-rotation 31*n* for regulating the rotation position, when the unit 200 rotates or moves by a predetermined angle. The portion-to-be-regulated 31*n* engages with the regulating portion 46 (FIG. 7, FIG. 8) of the main assembly (100A) as will be described hereinafter to be regulated in this position. The portion-to-be-regulated 31*n* is a through-hole, and a cross-sectional configuration thereof is triangular (FIG. 8). The upper portion of the right side plate 31R extended to the portion-to-be-regulated 31*n* is provided with a guide portion 310 for guiding a rotation regulating portion 46 to guide the regulating portion 46 on the portions-to-be-regulated 32*n*. On the top plate 31C which connects the left side plate 31L and the right side plate 31R of the frame 31 with each other, a portion-to-be-urged 31*p* which is pressed by a unit urging spring 35 of the cover 10 as will be described hereinafter and which positions the unit 200 in the main assembly 100A is provided. As has been described in the foregoing, there are provided cartridge mounting portions for dismountably carrying out to mounting of the cartridge 33 to the unit 32 fixed to the frame 31 (mounting portions) 32*l*. In this embodiment, the mounting portions 32*l* are the mounting portions for dismountably mounting the first-fourth cartridges 33Y, 33M, 33C, 33K.

(Image Forming Unit Mounting Portion)

As shown in FIG. 7, a left-hand side guiding plate 80L and a right-hand side guiding plate 80R is provided opposed to the inside of a left-hand side frame 110L of the main assembly 100A and the inside of a right-hand side frame 110R fixedly. The each of the guiding plates 80L and 80R is provided with a positioning portion 80*a* for supporting the left and right shaft portions 45L and 45R of the frame 31 rotatably and a guide portion 80*b* for guiding the shaft portions 45L and 45R to the positioning portion 80*a*. A guiding plate 80R is provided with a rotation regulating portion 80*c* which is continuous with the guide portion 80*b*. The portion-to-be-regulated-in-rotation 31*l* provided on the unit 200 contacts to the guiding plate 80R to limit the rotation of the unit 200. The upper portion of the guiding plate 80R is provided with the regulating portion 46 for regulating a rotational angle position of the unit 200 through the portion-to-be-regulated 31*n* of the unit 200, which is reciprocable. As shown in (*a*) of FIG. 8, a free end of the regulating portion 46 is provided with a tapered surface 46*a*. The regulating portion 46 is urged by the urging member toward main assembly 100A inwardly in the direction of the arrow Y0. The regulating portion 46 is provided with a flange portion 46*b*, which prevents a disengagement from the guiding plate 80R.

(Mounting of the Image Forming Unit)

The description will be made as to the mounting of the unit 200 into the main assembly 100A. A rear side of the cover 10 is rotatably coupled through a hinge shaft 10*a* to the main assembly 100A, and it is movable between the closing position G (FIG. 1B) for closing a top opening 100B of the main assembly 100A and the open position H (FIG. 7) for opening the opening 100B. The cover 10 is an opening and closing member which is rotatable for opening and closing the opening 100B in the upper portion of the main assembly 100A about the hinge shaft 10*a*. The closed state (closing position) of the cover 10 is maintained by the engagement (latch engagement) between a locking claw portion 36*a* provided on a maintenance button (36) provided on a front side of the main assembly 100A and the locking claw portion 10*b* provided on the cover 10, as shown in (*a*) of FIG. 9. The locking claw portion 36*a* is the main assembly side locking portion, and the locking claw portion 10*b* is an opening and closing member side locking portion. The closure releasing of the cover 10 is carried out by the user pushing a button 36. When the user pushes a button 36 rearwardly against the spring (unshown), the locking claw portion 36*a* on the button (36) side disengages from the locking claw portion 10*b* on cover (10) side backwardly to release the latch engagement, as indicated by chain lines. By this, the cover 10 is rotated to the open position H about the hinge shaft 10*a* to open the opening portion 100B greatly. In this embodiment, the locking claw portion 36*a* and the locking claw portion 10*b* are elastically locked with each other releasably. However, this embodiment is not limited to this example. For example, the claw (locking portion) provided on one side maybe elastically and releasably locked with the hole (locking portion) provided in another side.

As shown in (*a*) of FIG. 10, for the mounting of the unit 200 into the main assembly 100A, the user rotates the cover 10 to the open position H to greatly open the opening portion 100B. The user inserts the unit 200 into the main assembly 100A from the opening portion 100B. The left and right shaft portions 45L, 45R of the unit 200 is engaged with the guide portions 80*b* opposed to the guiding plates 80L and 80R of the main assembly (100A), and the unit 200 is mounted into the main assembly 100A. In this manner, the unit 200 is mounted into the main assembly 100A. Thereafter, the shaft portions 45L, 45R are contacted to the positioning portion 80*a* provided on an extension of the guide portion 80*b* ((*b*) of FIG. 10). At this time, the gear 34*b* (FIG. 6) provided at the one-end portion of the transfer member 34 engages with a driving gear (unshown) provided in the main assembly 100A. Thereafter, the user rotates the unit 200 in the direction of the arrow X2 shown in (*a*) of FIG. 11, while griping the grip 31*m*. The lower portion of the main assembly, 100A with respect to the direction of the arrow X2 is provided with a spring 48 on the top surface of a lower stay 110*c* of the main frame 110. When the unit 200 rotates, a spring 48 is contacted to a lower surface of the frame 31 of the unit 200, and eases an impact caused by a rotational operation of the unit 200. The unit 200 rotated in the direction of the arrow X2 is stopped, in the state that it is urged upwardly by the spring 48. Thereafter, the cover 10 is rotated to the closing position G to complete the mounting of the unit 200 into the main assembly 100A. More particularly, the unit 200 is rotatable about the shaft portions 45L and 45R, i.e., a rotational center 34*a* of the transfer member 34, between the left and right guiding plates 80L and 80R in the main assembly 100A. By this, the unit 200 is movable between the image forming position A (FIG. 1A and FIG. 2) for carrying out the image forming operation and the mounting and dismounting position B for mounting and demounting the cartridge 33 ((*b*) of FIG. 10). This will be described hereinafter.

Residual developer container (residual developer container) FIG. 11B is a right-hand side perspective view of the residual developer container 40, (*a*) of FIG. 12 is a left-hand side perspective view, and (*b*) is a sectional view taken along a line (12)-(12) of FIG. 11B. As has been described in the foregoing, in each unit 32 (32Y, 32M, 32C, 32K), the developer which remains on the surface of the drum 32*a* is removed by a cleaning blade (cleaning member) 32*c*, and thereafter, is fed by a feeding screw (feeding member) 32*e* in the feeding direction. The fed residual developer is contained in the container, 40 provided at the left-hand end portion of the unit 200 which is in the downstream side with respect to the feeding direction of the screw 32*e*. The container 40 comprises an accommodating portion 41 and a cover 42, which are unified by the welding and so on. The container part 41 is provided with a removed residual developer receiving opening 41*a* corresponding to the unit 32. Each opening 41*a* is placed in the recess 41*b* provided in the accommodating container 41, and the recess 41*b* has sufficient size permitting the passage of the removed developer discharging portion 32*f* of the unit 32. The circumference of each opening 41*b* is provided with a sealing member 43 for preventing the outward scattering of the developer by contacting the discharging portion 32*f*. The sealing member 43 is fixed by double coated tape or the like to the container part 41. The sealing member 43 is provided with the opening having substantially the same size as that of the opening 41*a*. An accommodating portion 41*c* is provided below the opening 41*a*, and it contains the residual developer received through the opening 41*a*. A right side of the container part 41 is provided with a portion-to-be-guided 41*d*-41*f* for facilitating mounting the container 40 to the unit 200. The container 40 is mounted and positioned to the unit 200 through the portions-to-be-guided 41*d*-41*f*. The cover 42 is provided with the grip 42*a* for mounting and demounting the container 40 relative to the unit 200. The grip 42*a* is provided by forming the recess in the cover 42. When an amount of the residual developer more than a predetermined amount is contained in the container 40, the user grips the grip 42*a* and dismounts the container 40 from the unit 200 to exchange it with a new container. Or, after the residual developer in the container 40 is discarded, the container 40 thereof may be re-used.

(Mounting to Image Forming Unit of Removed Developer Container)

The container 40 is mounted and demounted in the state that the unit 200 is placed in the mounting and dismounting position B ((*b*) of FIG. 10). As shown in FIG. 6A, or (*a*) of FIG. 13, the outside surface of the left side plate 31L of the frame 31 is provided with guide portions 31*m*1-31*m*3. The portions-to-be-guided 41*d*-41*f* provided in the container 40 is inserted in the direction of the arrow X3 into the guide portions 31*m*1-31*m*3 respectively. In the guide portion 31*m*2, the leaf spring urging member 49 is provided. After receiving the portion-to-be-guided 41*e*, an urging 49 elastically urges the portion-to-be-guided 41*e* in the direction of the arrow X4. The portion-to-be-guided 41*e* is urged to the urging member 49. In this manner, the portion to be positioned 41*e*1 (FIG. 11B) of the portion-to-be-guided 41*e* is contacted to a positioning portion 31*m*4 provided at a trailing end of a guide portion 31*m*2. In this manner, the portion-to-be-guided 41*e* is positioned with respect to the front-rear direction. The width (up-down direction) of the portion-to-be-guided 41*e* is substantially the same as that of the width (up-down direction) of the guide portion 31*m*2, and therefore, the positioning in the up-down direction is simultaneously carried out. Furthermore, the movement in the direction and the opposite direction of the arrow X3 is regulated by the urging member 49. Therefore, the portion-to-be-guided 41*e* does not separate during the rotational operation of the unit 200. As has been described in the foregoing, the container 40 is mounted and demounted relative to the unit 200 ((*b*) of FIG. 13). By a series of mounting operations, the shutter 32*g* provided in each unit 32 is moved to the open position by an actuator (unshown). When the mounting is completed, a reception side opening 41*a* provided in the container 40 opposes to the supplying side opening 32*g*1 provided in the unit 32, and can receive the residual developer fed by the feeding screw 32*e*.

In exchanging the container 40, as described above, while the user grips the grip 42*a*, the user dismounts the container 40 from the unit 200. In the state where the unit 200 is placed in the mounting and dismounting position B, the container 40 can be exchanged in the same position as the mounting and dismounting position B of the cartridge 33 as will be described hereinafter. In response to the operation which dismounts the container 40, an opening of the unit 32 is shut by a spring member of the shutter 32*g*. On the other hand, the member such as a shutter is not provided for the opening 41*a* of the container 40 in order to suppress a cost. However, in a mounting and demounting direction (the direction which is (a) of FIG. 13 X3 and the opposite direction thereto of the container 40), the opening 41*a* does not face downwardly with respect to the direction of gravity. In this manner, the leakage of the internal residual developer is minimized, without using the shutter or the like. The container 40 can be mounted and demounted relative to the unit 200. Therefore, the user can carry out the exchange of the cartridge 33 and the exchange of the container 40 through the same process, and therefore, the usability is improved. The mounting and demounting direction of the container 40 and the mounting and demounting direction of the cartridge 33 as will be described hereinafter are the same, and therefore, the user can carry out those operations easily. Here, the same direction is not in the strict sense, but the directions may slightly be deviated, if the mounting and demounting of the container 40 and the cartridge 33 can be performed, without changing the position of the unit 200. The guide portion 31*m*1-31*m*3 of the unit 200 for mounting the container 40 is provided on the outside surface of the sub-frame 31. Therefore, it is not necessary to provide the accommodating space for accommodating the container 40 in the frame 31, and therefore, the downsizing of a device can be accomplished. The mounting position for the container, 40 is provided in the non-driving side which is the side opposite from the driving side which is provided with the driving system (driving force transmitting portion) of the drum gear 32*a*1 and the feeding gear 32*f* or the like with respect to the axial direction of the drum 32*a*. Therefore, the latitude in the disposition of the driving system is enhanced, and as a result, the downsizing of the device is accomplished.

(Mounting of the Cartridge)

The mounting and demounting of each cartridges 33 33Y, (33M, 33C, 33K) relative to the unit 200 is carried out in the state that the unit 200 is placed in mounting and dismounting position B ((*b*) of FIG. 10). First, the cover 10 is moved to the open position which opens the opening portion 100B from the closing position which closes the opening portion 100B (FIG. 11A). Then, while griping the grip 31*m*, the user rotates the unit 200 to the mounting and dismounting position B ((*b*) of FIG. 10). When the cover 10 is rotated by a predetermined angle by the above-described rotational operation, the regulating portion 46 provided on the main assembly 100A engages with the portion-to-be-regulated 31*n* provided on the frame 31. At this time, the unit 200 is regulated by the regulating portion 46 in the mounting and dismounting position B. In other words, the unit 200 is temporarily fixed in the mounting and dismounting position B, and is limited in the movement toward the image forming position A. Since the unit 200 is regulated in the mounting and dismounting position B, the user can carry out a mounting and dismounting operation of the cartridge 33, while keeping the hand off the grip 31*m*. Therefore, the usability is satisfactory.

At first, the user grips a first grip 39 (FIG. 2) provided on the cartridges 33 (33M, 33C and 33K) and a part of developing device cases 33*a*. With respect to the cartridge 33Y, the user grips the first grip 39 and the flat surface portion 38*a* (FIG. 5) of a second grip 38. Or, only the second grip 38 is griped. Each cartridge 33 is mounted to the corresponding mounting portion 32*l* of the unit 200. The mounting direction is the direction (mounting direction) perpendicular to a rotational axis direction of a developing roller 32*b*.

In more detail, as shown in FIG. 20B, the portions-to-be-guided 33*e*1 of the right-hand side and left-hand side of the cartridge 33 (unshown) 33*e*3, are inserted into the mounting portion 32*l* of the right-hand side and left-hand side provided in the unit 32, respectively. Subsequently, the force receiving portion 33*e*2 (unshown), 33*e*4 provided in the upstream side with respect to the cartridge mounting direction of the portions-to-be-guided 33*e*1, 33*e*3, is inserted. The portion-to-be-guided 33*e*1-33*e*3 is guided by the mounting portion 32*l*, and it is inserted into the inside toward the drum 32*a*. The portions-to-be-guided 33*e*1, 33*e*3 are abutted to the force applying member 36 provided in the mounting portion 32*l*. The force applying member 36 in this embodiment is an L-shape member, and the portions-to-be-guided 33*e*1, 33*e*3 are abutted to the L-shape portion. In the free state of the regulating member 36, the regulating member 36 is raised by the urging force of the urging member 37, so that an L-shape portion enters the recess 32*la* of the mounting portion 32*l*, and abuts to and is stopped by the upper surface 32*la* of the ceiling surface. Furthermore, when the cartridge 33 is further inserted, the portion-to-be-guided 33*e*1, 33*e*3 pushes the L-shape portion of the force applying member 36 down against the urging force of the urging member 37 which urges the force applying member 36. By this, the regulating member 36 is pushed down in the arrow X5 away from the recess 32*la* of the mounting portion 32*l*, so that the portions-to-be-guided 33*e*1, 33*e*3 enter between the top surface of the force applying member 36 and the ceiling surface of the recess 32*la*. Here an urging direction of the urging member 37 is toward the mounting portion 32*l*. Thereafter, the portions-to-be-guided 33*e*1, 33*e*3 further moves, and passes by the position of the force applying member 36. Then, the force applying member 36 is moved in the direction of the arrow X6 by the urging force of the urging member 37 to return to the original position. The portion-to-be-guided 33*e*1, 33*e*3 depresses the force applying member 36 against the urging force, and the force applying member 36 returns to the original position, so that the urging force is released. In this manner, the user can feel a moderate mounting tactile. Thereafter, the force receiving portions 33*e*2, 33*e*4 abuts to the force applying member 36 to push the force applying member 36 down in the arrow X5 again. Furthermore, when the cartridge 33 is moved in the mounting direction, the spacers 51 at the left and right opposite ends of the developing roller 33*b* (FIG. 5) contact to the surface of the drum 32*a*. A part of a portion-to-be-guided 33*e*3 is contacted to a positioning portion 32*lc* which is in a free end portion of the mounting portion 32*l* ((*b*) of FIG. 14). On the other hand, in the opposite side, as shown in FIG. 15A, a gap g is provided between the portion-to-be-guided 33*e*1 and the mounting portion 32*l*.

As described above, the mounting operation is completed (FIG. 14B and FIG. 15A). At this time, the force receiving portions 33*e*2, 33*e*4 is rested in the state of receiving the force in the direction of the arrow X6 by the force applying member 36. As shown in FIG. 20B, a width We of the force receiving portions, 33*e*2, 33*e*4 with respect to the direction of the arrow X6 is smaller than a width Wa of the recess 32*la* of the mounting portion 32*l*. On the other hand, a width Wb of the portions-to-be-guided 33*e*1, 33*e*3 substantially has the same size as the width Wa of the recess 32*la* of the mounting portion 32*l*. The portions-to-be-guided, 33*e*1, 33*e*3 are provided between the developing roller s, 33*b* and the force receiving portions, 33*e*2, 33*e*4 with respect to the mounting direction X11, of the cartridge 33. Here, a line LX1 connecting the center of a cylindrical shape of the portions-to-be-guided 33*e*1, 33*e*3 and the center of the developing roller 32*b* and a line LX2 connecting the center of the developing roller 32*b* and the center of the drum 32*a* are crossed with each other, as the cross-section is seen in the direction of the rotation axis of the developing roller 33*b*. Furthermore, the direction LX1 and the arrow X6 which is the urging direction of the urging member 37 is crossed with each other. Therefore, the force receiving portions 33*e*2, 33*e*4 of the cartridge 33 receives the force F1 from the force applying member 36. By this, a moment in the direction of the arrow X10 is produced about the portions-to-be-guided 33*e*1, 33*e*3 to bring the spacer 51 provided at the opposite ends of the developing roller 33*b* into contact to the surface of the drum 32*a*. The spacer 51 is contacted with an urging force F2 to the drum 32*a*. In other words, by the force applying member 36, the developing roller 33*b* is positioned in the state of being urged relative to the drum 32*a*. Here, the distance between the portion (or the contact portion) of the developing roller 33*b* which opposes to the drum 32*a* and the portion-to-be-guided 33*e*3 (same at the opposite side 33*e*1) is a distance Z1, as the cross-section is seen in the direction of the rotation axis of the developing roller 33*b*. A distance between a position of receiving the force by the force applying member 36 of the force receiving portion 33*e*4 (33*e*2) and a portion-to-be-guided 33*e*3 is Z2. When the distance Z1 is compared with the distance Z2, z1<z2. Therefore, even if an application force F1 is small, the large urging force F2 can be provided, by this principle. In other words, the small urging force of the urging member 37 can be selected. Therefore, when the user mounts the developing cartridge 33, the mounting force is small. Therefore, the usability is good. In this embodiment, the force applying member 36 is unintegral with the urging member 37. However, the force applying member 36 may be omitted, wherein the force is applied to the force receiving portions 33*e*2, 33*e*4 only by an urging member. In this case, replacing with the coil urging member 37 of this embodiment, a plate urging member is preferable. In this embodiment, the urging member 37 applies the force in the force receiving portions 33*e*2, 33*e*4, in the arrow X6. On the other hand, the mounting direction of the cartridge 33 to the mounting portion 32*l*, is the arrow X11. The arrows X6, X11 is perpendicular relative to each other. As has been described in the foregoing, the directions of the forces are perpendicular relative to each other. By this, by the mounting operation of the cartridge 33 to the mounting portion 32*l*, the developing roller 33*b* can be positioned in the state of being urged relative to the drum 32*a*. In this embodiment, the arrows X6, X11 are perpendicular with each other. However, they may deviate from the right angle somewhat, and it will suffice if these directions cross with each other. However, the orthogonality is preferable, because, the urging force of the urging member 37 can be used efficiently.

As has been described in the foregoing, according to these embodiments, in positioning the developing roller 32*b* relative to the drum 32*a*, the user may just insert the developing cartridge 33 relative to the mounting portion 32*l*. In other words, the user is required just to mount it, and the user can mount the cartridge 33 without the other operation. Therefore, the usability is excellent. After mounting the cartridge, an urging member is moved in interrelation with a door of the main assembly. In this manner, the complicated mechanism for pressing the developing roller to the drum is unnecessary. In this embodiment, the urging member 37 or the force applying member 36 only is provided on a part of mounting portions 32*l*, and therefore, the structure is simple.

In this embodiment, the cartridge 33 is mounted to the mounting direction X11 perpendicular to the axis of the developing roller 33*b*, and by the mounting operation, the force is received from the urging member 37. Therefore, as compared with the type in which the cartridge 33 is mounted in the axial direction of the developing roller and in which the developing roller is urged to the drum by the mounting operation, there is less liability that the developing roller 33*b* rubs with the drum 32*a*. In other words, in the type in which the cartridge is mounted in the axial direction which is the developing roller, there is a liability that the developing roller rub with the drum in the process of a mounting of the cartridge. On the other hand, according to this embodiment, in the mounting process of the cartridge 33, the possibility that the surface of the drum 32*a* and the surface of the developing roller 33*b* rub to each other is low, and therefore the developing roller 33*b* or the drum 32*a* is not easily damaged.

In this embodiment, the image forming apparatus is a color image forming apparatus which is provided with a plurality of cartridge, but it may be a monochromatic image forming apparatus which is provided with a single cartridge.

(Movement to Image Forming Position of Image Forming Unit)

As shown in FIG. 15B, when the mounting of each cartridge 33 to the unit 200 is completed, the user rotates the unit 200 toward the image forming position A. First, the user grips the second grip 38 of the cartridge 33Y of the topmost stage of the unit 200, or grips the grip provided on the frame 31 of the unit 200, and the user applies the force in the direction of the arrow X8 to the unit 200. The regulating portion 46 disengages from the portion-to-be-regulated 31*n*, and the unit 200 becomes rotatable. As shown in (*b*) of FIG. 8, the regulating portion 46 and the portion-to-be-regulated 31*n* are provided with the surfaces inclined relative to the arrow X8 which is the rotational direction of the unit 200. As shown in FIG. 20B, by the rotational operation in the direction of the arrow X8, the portion-to-be-regulated 31*n* retracts the regulating portion 46 in the direction of the arrow Y1, so that the unit 200 is rotated. The urging member 47 which urges a regulating member 46 in the direction of the arrow Y0 provides the urging force more than a predetermined level, so that n the portion-to-be-regulated 31*n* does not separate from the regulating portion 46 in the mounting and demounting operation of the cartridge 33 in the mounting and dismounting position B of the unit 200. On the other hand, the regulation is released by the rotational operation by the user, because of the proper selection of the urging force. The unit 200 is rotated about the left shaft portion 45L and the right shaft portion 45R in the state of being supported by the positioning portion 80*a*.

The user moves the unit 200 in the arrow X8, while griping the grip 38 or the grip 31*m*. The user may grip whichever of the grip 38 or the grip 31*m*. In this embodiment, the second grip 38 provided in the cartridge 33Y is in the outside of the unit 200, and therefore, it is easy to grip it and easy to recognize it. In other words, the second grip 38 is placed in an outside position beyond the grip 31*m* with respect to the radial direction of the unit 200. The second grip 38 is provided with a recess 38*b* into which the user can insert the hand. The recess, 38*b* is opened to the outside with respect to a radial direction of the unit 200. Therefore, in moving the unit 200, it is easy to operate. The grip 38 is griped in order to rotate the unit 200, from the mounting and dismounting position B to the before-mounting-demounting-position C of (a) of FIG. 15, or, from the mounting and dismounting position B to the image forming position A. It is griped in order to rotate the unit 200 which is in the before-mounting-demounting-position C or the image forming position A to the mounting and dismounting position B. The first grip, 38 is provided on the cartridge 33Y in the downstreammost position with respect to the rotational direction (direction of the arrow X9) from the image forming position A toward the mounting and dismounting position B, among the cartridges 33 (33Y, 33M, 33C and 33K). When the cartridge 33Y is not mounted, it is preferable to grip the grip 31*m* provided on the frame 31.

When the user operates the unit 200 while gripping the grip 38, the portions-to-be-guided (portions-to-be-regulated) 33*e*1 and 33*e*3 is prevented from the movement by the regulating member 36 placed in the regulating position D. Therefore, even if the force is somewhat applied to the cartridge 33Y in the direction of separating out of the unit 200 in moving the unit 200 while griping the grip 38, the cartridge 33 is limited by the regulating member 36. Therefore, the cartridge 33Y does not disengage from the unit 200. The developing roller 33*b* is positioned in the state of urging to the drum 32*a*. Therefore, the operation of the unit 200 by the user does not cause the rubbing beyond the necessity to the surfaces of the drum 32*a* and a developing roller 3*b*. In other words, the force applying member 36 limits the disengagement of the cartridge 33Y, when the unit 200 is rotated to a before-mounting-demounting-position C from the mounting and dismounting position B, when the unit 200 rotates to the image forming position A, and when the unit 200 rotates in the opposite direction. The relative movement between the drum 32*a* and the developing roller 33*b* is limited. At this time, the force applying member 36 is placed in the regulating position D. The urging force of the urging member 37 which urges the force applying member 36 is set such that the outward movement of the cartridge 33Y is limited, when the user rotates the unit 200 while griping the grip 38. The urging force is set such that in the mounting and dismounting position B, the portions-to-be-guided 33*e*1 and 33*e*3 move the force applying member 36 to the permission position E in accordance with the user's mounting and demounting operation, thereby to ride over the force applying member 36. Also in the other cartridges 33 (33M, 33C and 33K), the portions-to-be-guided 33*e*1 and 33*e*3 are regulated by the force applying member 36, and therefore, they do not disengage outwardly of the unit 200. The portions-to-be-guided 33*e*1 and 33*e*3 are regulated by the mounting portion 32*l* in the up-down direction. Therefore, even if the user moves the unit 200 in the direction of the arrows X8, X9 while griping the grip 38, the cartridge 33Y does not separate.

In the main assembly 100A, the top surface of a lower side stay 110*c* of a frame 110 is provided with a spring member urging member 48. When the unit 200 is rotated from the mounting and dismounting position B of FIG. 15B to the image forming position A, the lower surface of the frame 31 of the unit 200 contacts to the above described spring member 48 in a position C before the image forming position A, as shown in FIG. 16A. Therefore, even if the user rotates the unit 200 downwardly with a quite strong force, such a force can be accommodated by the elastic force of the spring member) 48. The urging force of the spring member 48 is sufficiently larger than the force which a weight of the unit 200 applies downwardly. Therefore, the unit 200 is rested in the state of receiving the urging force from the spring member 48. At this time, a portion-to-be-regulated-in-rotation 31*l* ((*b*) of FIG. 6) of the unit 200 is not abutted to the rotation regulating portion 80*c* ((*a*) of FIG. 7) provided on the guiding plate 80R, and therefore, it is in a position before the image forming position A. This position is a before-mounting-demounting-position C. The provision of the spring member 48 can prevent the breakage of the members in the unit 200, the cartridge 33, the photosensitive member unit 32, and the main assembly 100A attributable to the impact and so on, when the user rotates the unit 200. The spring 48 may be provided in the unit 200, and what is necessary is just to provide it between the unit 200 and the main assembly 100A. In other words, in moving the unit 200 from the mounting and dismounting position B to the image forming position A, it may be interposed between the unit 200 and the main assembly 100A. In this embodiment, as the spring member 48, the leaf spring member is used, but it may be a coil spring or the like. Depending on the weight of the unit 200, the cartridge 33 and so on inserted there, the spring member 48 may be omitted. FIG. 17 is a view (a) in the case of the spring 48 being omitted. In this case, the lower surface of the sub-frame 31 is directly received by the top surface of the lower side stay 110*c* of the main frame 110 not through the before-mounting-demounting-position C, so that it is placed in the image forming position A. As shown in FIG. 16B, in the state that the unit 200 is positioned in the before-mounting-demounting-position C, the user stops the gripping of the second grip 38 or the grip 31*m*, and moves the cover 10 from the open position H to the closing position G (*b* of FIG. 16). The cover 10 rotates to the front position beyond than the closing position G. Then, the urging spring (urging member) 35 provided in an inner surface of the cover 10 contacts to the portion-to-be-urged 31*p* (FIG. 6) provided on the top plate 31C of the frame 31 of the unit 200 placed in the before-mounting-demounting-position C. Also thereafter, the cover 10 is rotated in the closing direction against the urging forces of the spring 35 and the spring member 48. The urging force of the spring 35 is larger than the urging force (elastic force) of the urging spring 48. Therefore, the unit 200 is contacted to the positioning portion 80*a* in the shaft portions 45L, 45R thereof against the urging force of the urging spring 48. Furthermore, the portion-to-be-regulated-in-rotation 31*l* is contacted to the rotation regulating portion 80*c* provided on the guiding plate 80R. By this, the unit 200 is positioned in the image forming position A relative to the main assembly 100A. As shown in (*b*) of FIG. 9, the locking claw portion 10*b* provided in the cover (10) side corresponds to a locking claw portion 36*a* provided in the maintenance button (36) side. By the further rotation of the cover 10 in the closing direction, the cover 10 sufficiently moves to the closing position G. Then, the cover (10) side locking claw portion 10*b* engages with the locking claw portion 136*a* in the side of the button (136) (latch engagement) ((*a*) of FIG. 9). By this, the cover 10 is locked with the closing position G. The cover 10 is urged in the open direction by a compressive reaction forces (elastic forces) of the spring 35 and the spring member 48. However, as has been described in the foregoing, the cover 10 is fixed to the main assembly 100A by the locking claw portions 10*b*, 36*a*. For this reason, the unit 200 rest in the image forming position A by being pressed to the main assembly 100A by the spring 35 ((*b*) of FIGS. 1 and (*a*) of FIG. 1). In more detail, the unit 200 is locked to the image forming position A by the cooperation of the cover 10 the cover side locking claw portion 10*b*, the maintenance button side locking claw portion 10*b*, the spring 35, and the portion-to-be-regulated 31*l*, and the regulating portion 80*c*. In this embodiment, the spring 35 is mounted to the cover 10. However, the urging spring may be provided in the unit 200, wherein a part of cover 10 is contacted to the urging spring. In other words, the structure may be such that it is interposed and contacted between the unit 200 and the cover 10 in interrelation with the closing operation of the cover 10.

By the above-described operation, the image forming apparatus 100 becomes in the state that an image forming operation (print operation) can be carried out, and the image forming operation described above is carried out on the basis of an image formation start signal (print start signal). The drive outputting portion (unshown) of the main assembly (100A) side is coupled with the gear 34*b* of the drive inputting portion of the intermediary transfer member 34 of the unit 200 placed in the image forming position A. The drum gear 32*a*1 of each photosensitive member unit 32 couples with the gear 34*b*. The gear 50 of the developing roller 33*b* couples with it. The electric power supply system of the main assembly side is electrically connected to the electrical contacts of the photosensitive member units 32 and the cartridges 33. By this, the image forming apparatus 100 is capable of carrying out the image forming operation.

In the image forming apparatus 100 in this embodiment, the scanner unit 11, the cartridge 33, the drum 32*a*, the transfer member 34, and the feeding path Z for the recording material S are disposed substantially in parallel with the installation surface F, as shown in FIG. 1B. In the upper portion of the device 100, the cover 10 functioning also as the discharging tray is provided, and the cassette 19 is disposed at the lower portion of the device 100. The laser beams L (LY, LM, LC, LK) are projected from the unit 11 to the drum 32*a* in the rear part of the cartridge 33. The color developer image transferred onto the transfer member 34 from each drum 32*a* is transferred onto recording material S in the opposite side from each drum 32*a* with respect to the transfer member 34. Furthermore, according to these embodiments, in the state that the drum 32*a* is mounted to the unit 200, and the cartridge 33 is mounted to the unit 200 mounting portion 32*l*, the unit 200 can be rotated between the image forming position AA and the mounting and dismounting position B. The unit 200 is rotated from the image forming position A to the mounting and dismounting position B. In this manner, the cartridge 33Y may be mounted and demounted relative to the unit 200. By such a structure, the device 100 can be downsized.

(Exchange of Cartridge and Residual Developer Container)

In each cartridge 33 (33Y, 33M, 33C, 33K), the developer contained in the developer accommodating portion 33*c* of the cartridge 33 is consumed, as it is used for the image formation. Means unshown for, detecting a developer remainder of each cartridge 33 is provided, and the control circuit portion 300 compares a detected remaining amount value with the threshold for the lifetime forenotice and a lifetime warning of a cartridge set beforehand. For the cartridge 33 with which the detected remaining amount value is lower than the threshold, a lifetime forenotice or the lifetime warning of the cartridge 33 is displayed on a display portion 102 ((*a*) of FIG. 1) provided in an operating portion 101 of the image forming apparatus 100. Or, the lifetime forenotice or the lifetime warning about the cartridge 33 thereof is displayed on the display portion (unshown) of the external host device 400. By this, a preparation of the cartridge for the exchange is prompted, or, the exchange of the cartridge is prompted for the user. Also with respect to the container 40, it is detected that the residual developer more than the predetermined level is contained in the container, and the event is displayed on the display portion 102 and so on to prompt the user to the exchange of the container 40. <0563>INVENTION:

In the image forming apparatus 100 of this embodiment, the exchange of each cartridge 33 mounted to the unit 200 and the exchange of the container 40 are carried out by opening the top opening 100B of the main assembly 100A by opening the cover 10. As shown in FIG. 1A, the releasing of the closure of the cover 10 locked to the closing position G is effected by pushing a maintenance button 36 provided on the front side of the main assembly 100A as indicated by the chain line of (*a*) of FIG. 9. The user pushes the button 36 rearwardly against the spring unshown. In this manner, the button (36) side locking claw portion 36*a* escapes from the cover (10) side locking claw portion 10*b* rearwardly as indicated by the chain line to release the latch engagement. In this manner, the cover 10 is pushed up by the compressive reaction forces (elastic forces) of the spring 35 and the spring 48. The cover 10 is rotated in an open direction from the main assembly 100A by an angle corresponding to an operation distance (restoration length to a free length) of the spring 35 and spring member 48 about the hinge shaft 10*a*. More particularly, the cover 10 becomes partly open state automatically by the elastic forces of the spring 35 and the spring member 48. Part (*b*) of FIGS. 9 and (*b*) of FIG. 16 show the partly open state of the cover 10. Thereafter, when the user lifts the finger from the button 36, the force (elastic force) of the urging spring (unshown) restores it to the previous position. At this time, the locking claw portion 10*b* is at an upper portion by the partially open movement of the cover 10. Therefore, it does not engage with the restored locking claw portion 36*a* ((*b*) of FIG. 9). The user places a fingers on a grip portion 10*d* of the cover 10 in the partly open state, and opens the cover 10 by a manual operation to the open position H, as shown in (a) of FIG. 15. The cover 10 is sufficiently opened to the open position H it so that it is received by a stopper portion of the main assembly side, and thereafter, even if the user moves the hand off, the state is maintained stably. Or, it is locked by a click stop mechanism and a catching mechanism to stably maintain the opening state even if the user moves the hand off since then. By this, the opening portion 100B is sufficiently opened greatly. The unit 200 is released from the urging force (a pressing) by the urging spring 35 by the releasing of a locking of the cover 10 relative to the closing position G. By this, the unit 200 is moved from the image forming position A to the before-mounting-demounting-position C by the urging force of the spring member 48. The unit 200 moved to the before-mounting-demounting-position C is exposed through the opened opening portion 100A. When the user looks at the unit 200 which is in the before-mounting-demounting-position C, a next direction of the operation of the unit 200 is suggested. In other words, the user looking in the movement (direction of the arrow X9) toward mounting and dismounting position of the cartridge 33 mounted to the unit 200 can feel the next operation, in the direction of the arrow X9, of the unit 200 intuitively, and therefore, it assists the user's operation. The second grip 38 of the cartridge 33Y and the grip 31*m* of the sub-frame 31 projects in the rotational direction (toward the opening portion 100B) of the unit 200. Therefore, the user recognizes the second grip 38 and the grip 31*m* easily, and therefore it is easy to carry out the subsequent operation. While the user grips the first grip 38 or the grip 31*m*, the user rotates or moves the unit 200 in the direction of the arrow X9 to place the unit 200 in the mounting and dismounting position B (FIG. 14B). In the case where the spring member 48 is not used ((*a*) of FIG. 17), the user moves the unit 200 placed in the image forming position A to the mounting and dismounting position B, while griping the second grip 38 or the grip 31*m*. The (100 main assembly A) side regulating portion 46 engages with the unit (200) side portion-to-be-regulated 31*n* as described above, by which, the unit 200 which is in the mounting and dismounting position B is temporarily fixed in the mounting and dismounting position B to regulate the movement toward the image forming position A. In this state, the cartridge 33 and the container 40 or the cartridge 33 or the container 40 is dismounted in the opposite direction. In other words, when the unit 200 is placed in the mounting and dismounting position B, the cartridge 33 and the container 40 is detachably mountable relative to the unit 200.

With the structure of the above-described image forming apparatus, the exchange of the cartridge 33 is possible, without retracting a scanner unit (image exposure device) 11. By this, the user can exchange the developing cartridge 33 easily. The transfer member 34 is in the form of a drum, and the unit 200 is rotatable about the center axis of the transfer member 34. By this, in the movement of the unit 200 between the image forming position A and the mounting and dismounting position B, there is no necessity of retracting the member in the main assembly 100A more than needed. The internal cartridge 33 can be exchanged without drawing the unit 200 to an outside the main assembly 1010A. For this reason, the device 100 can be downsized. In this embodiment, the transfer member is the intermediary transfer member 34 for transferring the image indirectly onto the recording material S from the drum 32*a*. However, this is not inevitable, and it may be of the type of transferring the image directly onto the recording material S from the drum 32*a*. At this time, the transfer member 34 transfers the developed image directly from the drum 32*a* onto the recording material S.

The structure of the image forming apparatus 100 of the above-described Embodiment 2 is summarized as follows. The apparatus is an electrophotographic color image forming apparatus 100 for forming a color image on recording material S. It is provided with an electrophotographic photosensitive drum 32*a*. It is provided with the cartridges 33 33Y, 33M, 33C, 33K which are provided with the developing roller 33*b* for developing an electrostatic latent image formed on the drum 32*a*. The cartridge 33 is provided with the developer for the development and the force receiving portions 33*e*2, 33*e*4, and is mounted in the mounting direction X11 perpendicular to the axis of the developing roller 33*b*. The apparatus is provided with the urging member 37 for urging the cartridge 33. By the operation of mounting the cartridge 33, the force receiving portions 33*e*2, 33*e*4 receives the force from the urging member 37, and the developing roller 33*b* is urged to the drum 32*a*. An urging direction X6 of the urging member 37 crosses with the mounting direction X11. The cartridge 33 is provided with the portions-to-be-guided 33*e*1, 33*e*3 for being guided at the time of a mounting of the cartridge. The portion-to-be-guided is between the developing roller s, 33*b* and the force receiving portions, 33*e*2, 33*e*4 with respect to the mounting direction X11 of the cartridge 33. By the moment about the portions-to-be-guided 33*e*1, 33*e*3 of the force receiving portions 33*e*2, 33*e*4 urged by the urging member 37, the developing roller 33*b* is urged toward the drum 32*a*. In the sectional plane facing in the direction of the rotation axis of the developing roller 33*b*, the line LX1 connecting the center of the cylindrical shape of the portions-to-be-guided 33*e*1, 33*e*3 and the center of the developing roller 33*b* and the line LX2 connecting the center of the developing roller 33*b* and the center of the drum 32*a* are crossed relative to each other. It comprises an image forming unit 200, which is provided with the drum 32*a*, the transfer member 34 for transferring the developer image formed on the drum 32*a* onto the recording material S, and the urging member 37. The unit 200 is movable between the image forming position A for carrying out the image formation and the mounting and dismounting position B away from the position A where the cartridge is mountable and demountable relative to the main assembly 100A of the device 100 in the state that the cartridge 33 is mounted. The urging member 37 prevents the cartridge 33 from moving out of the unit 200 at the time of the movement between the image forming position A and the mounting and dismounting position B. The unit 200 is rotatable between the image forming position A and the mounting and demounting position B.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 2009-069962 filed Mar. 23, 2009, which is hereby incorporated by reference.

What is claimed is:

1. An electrophotographic image forming apparatus for forming an image on a recording material, comprising:

an electrophotographic photosensitive drum;

a cartridge including a developing roller for developing an electrostatic latent image formed on said electrophotographic photosensitive drum, said cartridge containing a developer for effecting development; and an urging member for urging said cartridge;

a transfer member for transferring a developed image formed on said electrophotographic photosensitive drum onto the recording material; and an image forming unit, including said electrophotographic photosensitive drum and said transfer member, for detachably mounting said cartridge, wherein said image forming unit is movable between an image forming position for effecting image formation and a mounting and demounting position where said cartridge is mountable and demountable, wherein said urging member urges said developing roller to said electrophotographic photosensitive drum by applying a force to said cartridge and prevents dismounting, at the time when said image forming unit moves between the image forming position and the mounting and demounting position, of said cartridge out of said image forming unit by applying the force to said member cartridge, and wherein said image forming unit is rotatable between the image forming position and the mounting and demounting position.

2. An apparatus according to claim 1, wherein an urging direction of said urging member crosses with a mounting direction in which said cartridge is mounted to said image forming unit.

3. An apparatus according to claim 2, wherein said cartridge includes a force receiving portion for receiving a force from said urging member, a portion to be guided to be guided in mounting said cartridge, said portion to be guided being provided between a center of said developing roller and said force receiving portion with respect to the mounting direction, wherein said force receiving portion urges said developing roller to said electrophotographic photosensitive drum by a moment produced about said portion to be guided by said urging member.

4. An apparatus according to claim 3, wherein said portion to be guided has a cylindrical shape, and wherein a line connecting a center of said portion to be guided and a center of said developing roller, and a line connecting a center of said developing roller and a center of said electrophotographic photosensitive drum, cross with each other as seen in a direction along a rotational axis of said developing roller.

5. An apparatus according to claim 4, wherein said image forming unit moves between the image forming position and the mounting and demounting position by rotating about the rotational axis of said transfer member.

* * * * *